US011504870B2

(12) United States Patent
Kosuge et al.

(10) Patent No.: US 11,504,870 B2
(45) Date of Patent: Nov. 22, 2022

(54) TAPE CUTTER AND TAPE PRINTING APPARATUS

(71) Applicant: SEIKO EPSON CORPORATION, Tokyo (JP)

(72) Inventors: Shinsaku Kosuge, Matsumoto (JP); Hirosuke Yasuki, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 396 days.

(21) Appl. No.: 16/883,064

(22) Filed: May 26, 2020

(65) Prior Publication Data

US 2020/0406488 A1 Dec. 31, 2020

(30) Foreign Application Priority Data

Jun. 26, 2019 (JP) ..... JP2019-118240

(51) Int. Cl.

| | |
|---|---|
| ***B41J 11/66*** | (2006.01) |
| ***B41J 29/13*** | (2006.01) |
| ***B26D 3/08*** | (2006.01) |
| ***B26D 7/26*** | (2006.01) |
| ***B41J 11/70*** | (2006.01) |
| ***B41J 3/36*** | (2006.01) |
| ***B41J 3/407*** | (2006.01) |

(52) U.S. Cl.

CPC ..... *B26D 3/085* (2013.01); *B26D 7/2614* (2013.01); *B41J 3/36* (2013.01); *B41J 3/4075* (2013.01); *B41J 11/666* (2013.01); *B41J 11/703* (2013.01)

(58) Field of Classification Search

None

See application file for complete search history.

(56) References Cited

U.S. PATENT DOCUMENTS

| | | | |
|---|---|---|---|
| 5,556,213 | A | 9/1996 | Kudo et al. |
| 2005/0061132 | A1 | 3/2005 | Sodeyama |
| 2008/0069622 | A1 | 3/2008 | Sodeyama |
| 2010/0247208 | A1 | 9/2010 | Yamaguchi et al. |
| 2010/0247212 | A1 | 9/2010 | Yamaguchi et al. |

(Continued)

FOREIGN PATENT DOCUMENTS

| | | | |
|---|---|---|---|
| CN | 1590117 | A | 3/2005 |
| CN | 201989425 | U | 9/2011 |

(Continued)

*Primary Examiner* — Leslie J Evanisko

(74) *Attorney, Agent, or Firm* — Oliff PLC

(57) ABSTRACT

Provided is a tape printing apparatus including a half cutter and a mounting portion lid. The half cutter has a half-receiving portion and a half-movable portion, the half-movable portion includes a half-movable blade and comes into contact with or separates from the half-receiving portion, a first side, which is one side of the half-movable blade in a blade length direction, is open between the half-receiving portion and the half-movable portion, and the mounting portion lid opens and closes a cutter mounting portion on which the half cutter is mounted. The mounting portion lid is provided with a lid-side half-receiving support portion that supports at least one of an end on the first side of the half-receiving portion and an end on the first side of a third frame portion that supports the half-receiving portion pressed by the half-movable portion when the mounting portion lid is closed.

3 Claims, 34 Drawing Sheets

(56) References Cited

U.S. PATENT DOCUMENTS

| | | | | |
|---|---|---|---|---|
| 2011/0158732 | A1* | 6/2011 | Kosuge | B41J 11/703 400/621 |
| 2016/0059589 | A1 | 3/2016 | Murata | |
| 2016/0229210 | A1 | 8/2016 | Yamaguchi et al. | |

FOREIGN PATENT DOCUMENTS

| | | | |
|---|---|---|---|
| CN | 105383183 | A | 3/2016 |
| JP | H06-286241 | A | 10/1994 |
| JP | H07-195297 | A | 8/1995 |
| JP | 2005-059183 | A | 3/2005 |
| JP | 2005-059503 | A | 3/2005 |
| JP | 2016-052773 | A | 4/2016 |

* cited by examiner

TAPE CUTTER AND TAPE PRINTING APPARATUS

The present application is based on, and claims priority from JP Application Serial Number 2019-118240, filed Jun. 26, 2019, the disclosure of which is hereby incorporated by reference herein in its entirety.

BACKGROUND

1. Technical Field

The present disclosure relates to a tape printing apparatus including a half cutter.

2. Related Art

In the related art, as disclosed in JP-A-6-286241, there is known a half cut mechanism that has a receiving base and a movable blade which comes into contact with or separates from the receiving base and that half-cuts a tape by a movable portion pressing the receiving base through the tape.

When the movable portion presses a receiving portion, in a case in which the receiving portion is displaced to the side opposite to the movable portion by the pressing force received from the movable portion, the pressing force received by the receiving portion from the movable portion escapes, and the tape cannot be appropriately half-cut.

SUMMARY

According to an aspect of the present disclosure, there is provided a tape printing apparatus including a half cutter and a lid. The half cutter has a receiving portion and a movable portion, the movable portion includes a blade and comes into contact with or separates from the receiving portion, a first side, which is one side of the blade in a blade length direction, is open between the receiving portion and the movable portion, and the lid opens and closes a cutter mounting portion on which the half cutter is mounted. The lid is provided with a lid-side receiving support portion that supports at least one of an end on the first side of the receiving portion and an end on the first side of a support portion that supports the receiving portion pressed by the movable portion when the lid is closed.

DESCRIPTION OF EXEMPLARY EMBODIMENTS

Figure 1:
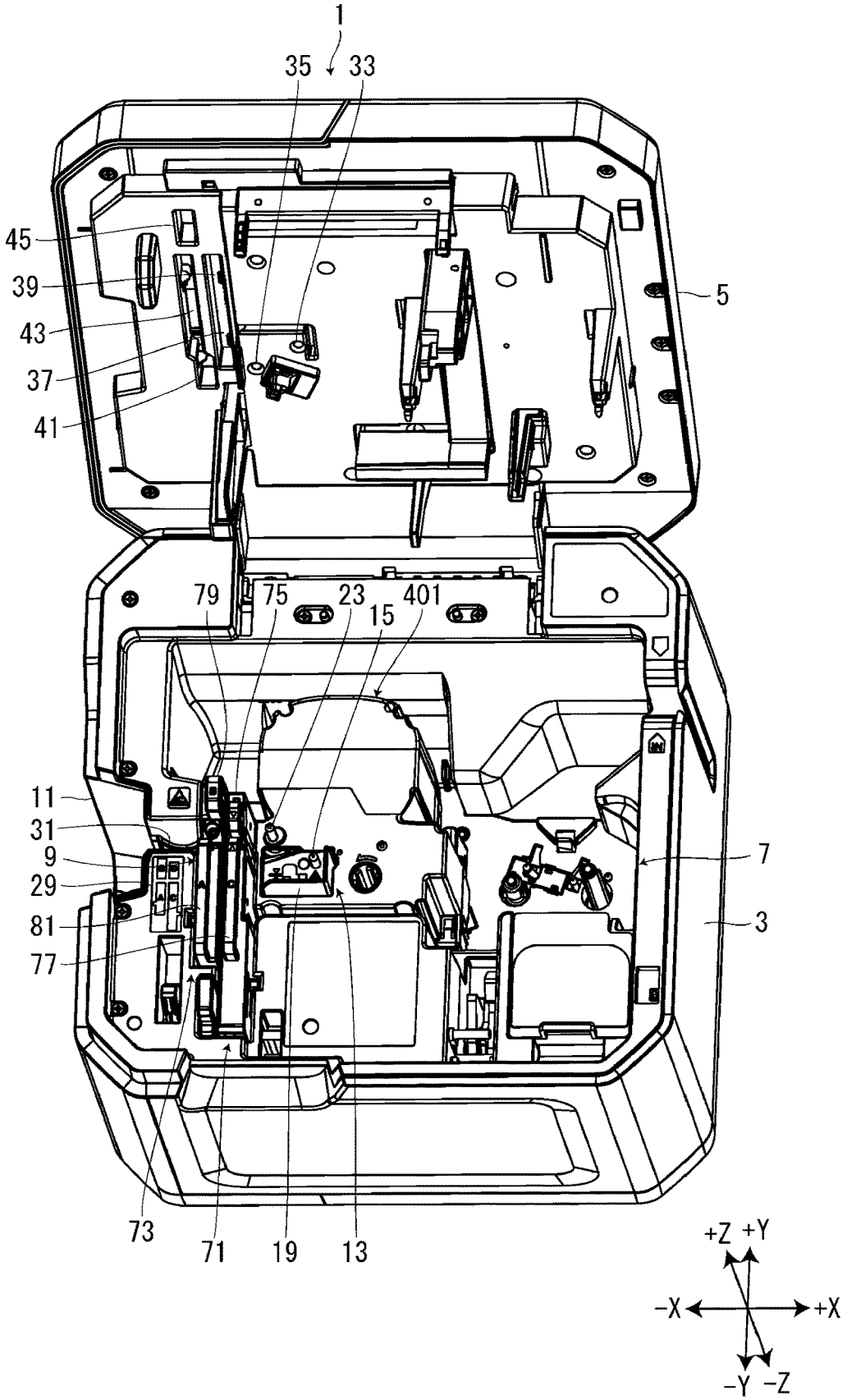
FIG. 1 is a perspective view of a tape printing apparatus.

Hereinafter, an embodiment of a tape printing apparatus will be described with reference to the accompanying drawings. The XYZ orthogonal coordinate system shown in the drawings is merely for convenience of description, and does not limit the following embodiment at all. The numerical values indicating the number of each portion are merely examples, and do not limit the following embodiment at all.

Tape Printing Apparatus and Tape Cartridge

As illustrated in FIGS. 1 to 4, a tape printing apparatus 1 includes an apparatus case 3 and a mounting portion lid 5.

The apparatus case 3 is formed in a substantially rectangular parallelepiped shape. A cartridge mounting portion 7 and a cutter mounting portion 9 are provided on a +Z side surface of the apparatus case 3.

A tape cartridge 401 is detachably mounted on the cartridge mounting portion 7. A tape discharge port 11 is provided on a −X side surface of the apparatus case 3. A tape 413 fed from the tape cartridge 401 mounted on the cartridge mounting portion 7 is discharged from the tape discharge port 11.

The mounting portion lid 5 opens and closes the cartridge mounting portion 7 and the cutter mounting portion 9. The mounting portion lid 5 is rotatably attached to a +Y side end of the apparatus case 3. Although not illustrated, a keyboard and a display are provided inside the mounting portion lid 5. The keyboard receives input operations of print information such as character strings and various instructions such as print execution. The display displays various information in addition to the print information input from the keyboard.

The cartridge mounting portion 7 is formed in a recessed shape with the +Z side opened. A head portion 13 is provided on a bottom surface of the cartridge mounting portion 7. The head portion 13 includes a head shaft 15, a print head 17, and a head cover 19. The head shaft 15 extends in the Z direction and rotatably supports the print head 17. The head shaft 15 is supported by a base frame 21 built in the −Z side of the cartridge mounting portion 7 in a cantilever manner (see FIG. 4). The print head 17 is a thermal head provided with a heating element. The head cover 19 covers a part of the print head 17. The +Z side of the head shaft 15 is opened and closed by the mounting portion lid 5.

The cartridge mounting portion 7 is provided with a platen shaft 23, a feeding shaft 25, and a take-up shaft 27. The platen shaft 23, the feeding shaft 25, and the take-up shaft 27 extend in the Z direction, and are supported by the base frame 21 in a cantilever manner (see FIG. 4). The +Z side of the platen shaft 23, the feeding shaft 25, and the take-up shaft 27 is opened and closed by the mounting portion lid 5.

Figure 2:
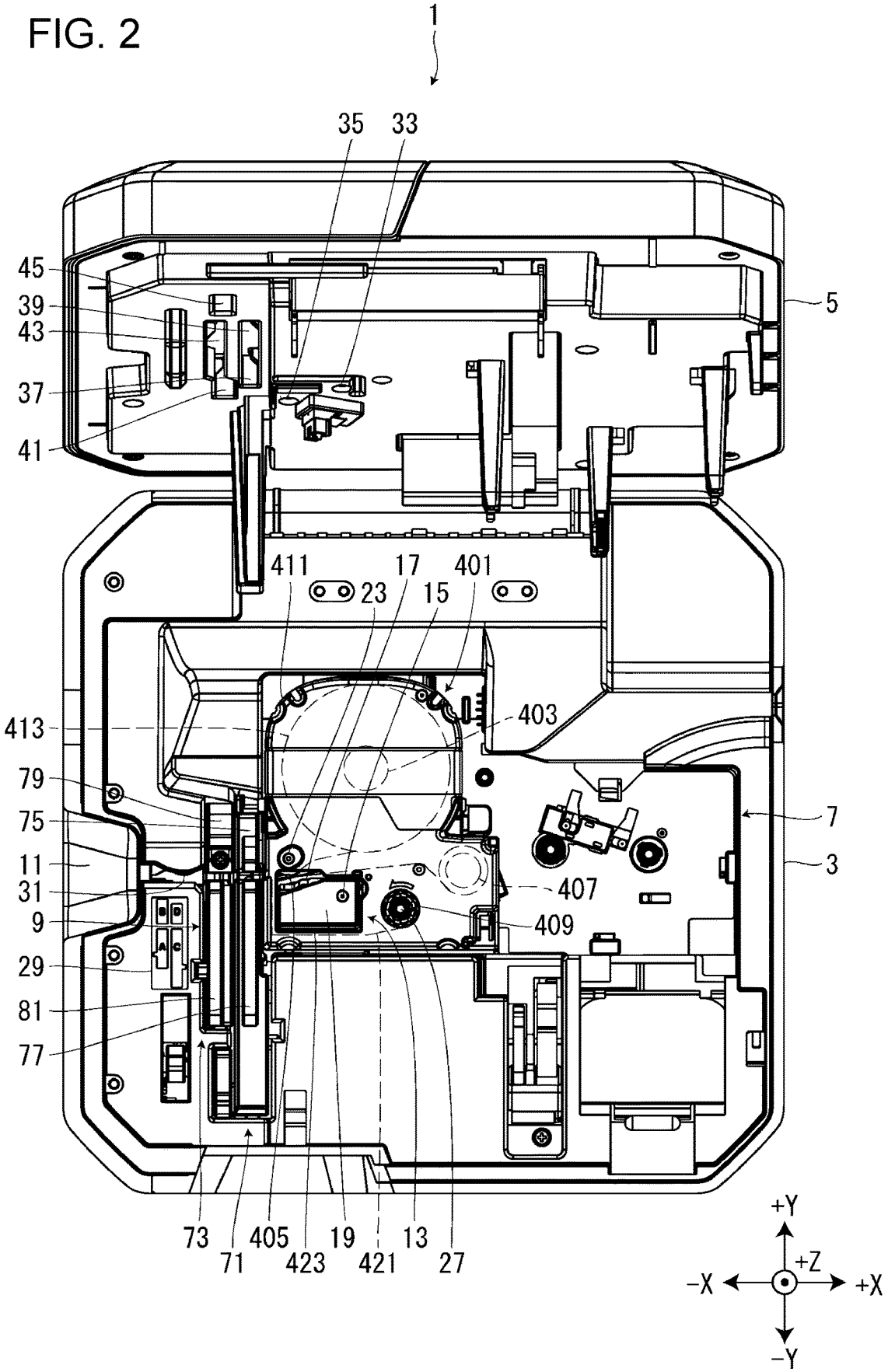
FIG. 2 is a view of the tape printing apparatus with a tape cartridge, a full cutter, and a half cutter mounted thereon, as viewed from the +Z side.
Figure 5:
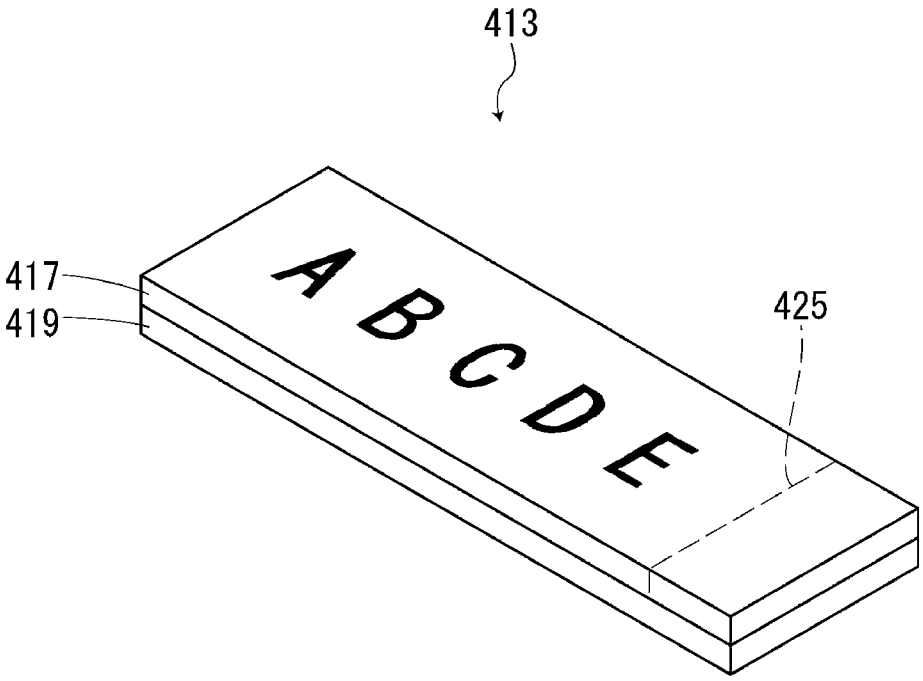
FIG. 5 is a perspective view of a tape.

As illustrated in FIG. 2, the tape cartridge 401 includes a tape core 403, a platen roller 405, a feeding core 407, a take-up core 409, and a cartridge case 411 accommodating these. The tape 413 is wound around the tape core 403. The tape 413 fed from the tape core 403 is fed out of the cartridge case 411 from a tape outlet (not illustrated) provided on an −X side wall portion of the cartridge case 411. The tape 413 includes a print tape 417 on which printing is performed by the print head 17, and a release tape 419 that is releasably attached to an adhesive surface of the print tape 417 (see FIG. 5). An ink ribbon 421 is wound around the feeding core 407. The ink ribbon 421 fed from the feeding core 407 is taken up by the take-up core 409. The cartridge case 411 is provided with a head insertion hole 423 penetrating in the Z direction.

When the tape cartridge 401 is mounted on the cartridge mounting portion 7, the head portion 13, the platen shaft 23, the feeding shaft 25, and the take-up shaft 27 are inserted into the head insertion hole 423, the platen roller 405, the feeding core 407, and the take-up core 409, respectively. The platen shaft 23, the feeding shaft 25, and the take-up shaft 27 rotatably support the platen roller 405, the feeding core 407, and the take-up core 409, respectively.

The cutter mounting portion 9 is provided between the cartridge mounting portion 7 and the tape discharge port 11. The cutter mounting portion 9 is formed in a recessed shape with the +Z side opened. A full cutter 71 and a half cutter 73 of a cutting portion 67 to be described later are detachably mounted on the cutter mounting portion 9. The +Z side of the mounted full cutter 71 and half cutter 73 is opened and closed by the mounting portion lid 5.

Figure 6:
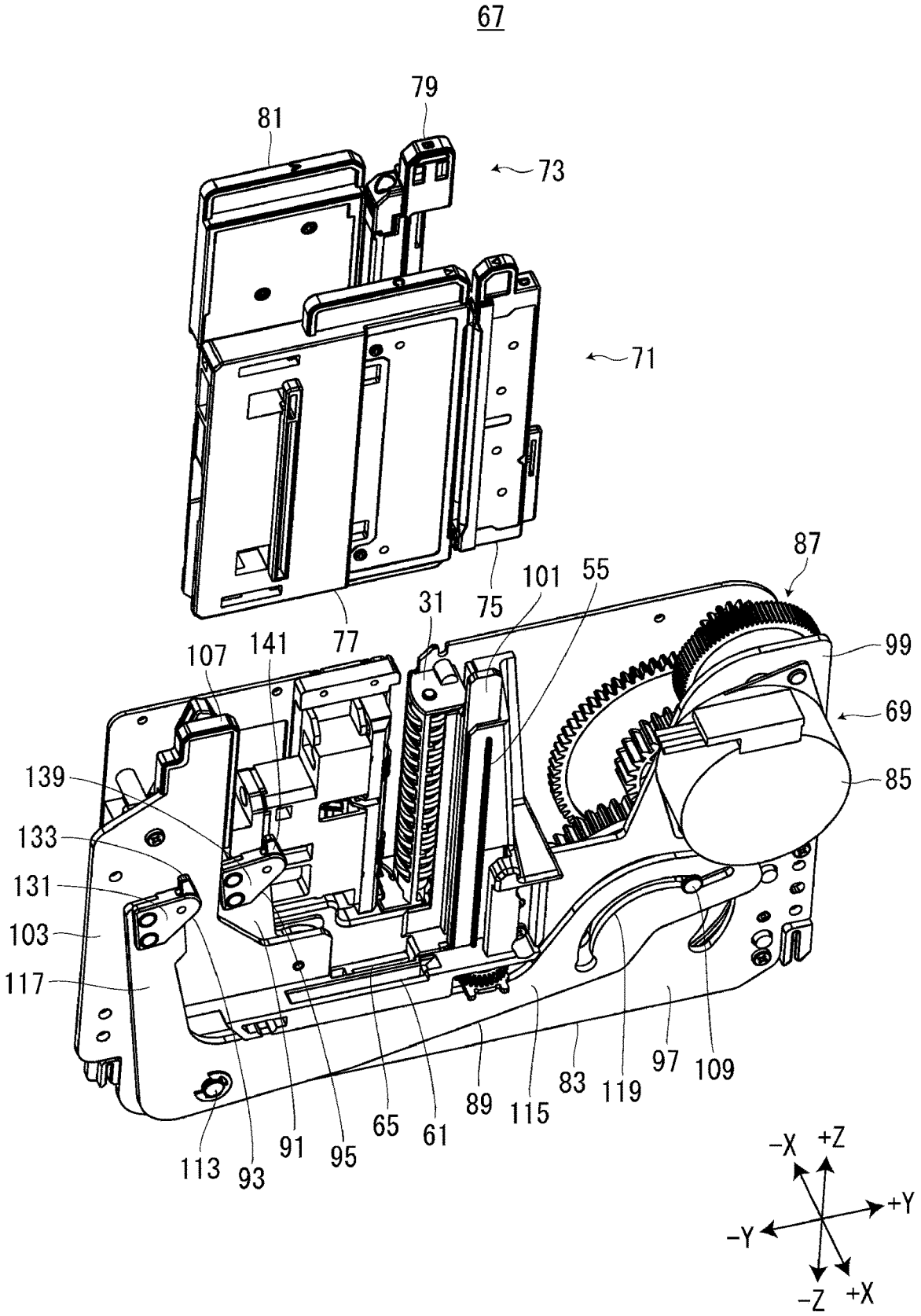
FIG. 6 is a perspective view of a cutting portion.

As illustrated in FIG. 6, the full cutter 71 includes a full-receiving portion 75 and a full-movable portion 77 mounted on the −Y side of the full-receiving portion 75. The full-movable portion 77 comes into contact with or separates from the full-receiving portion 75, and fully cuts the tape 413 between the full-movable portion 77 and the full-receiving portion 75. Note that, the contact or separation means approaching or moving away. The fully-cut means cutting both the print tape 417 and the release tape 419.

The half cutter 73 is mounted on the −X side of the full cutter 71. The half cutter 73 includes a half-receiving portion 79 and a half-movable portion 81 mounted on the −Y side of the half-receiving portion 79. The half-movable portion 81 comes into contact with or separates from the half-receiving portion 79, and half-cuts the tape 413 between the half-movable portion 81 and the half-receiving portion 79. Note that, the half-cut means cutting one of the print tape 417 and the release tape 419 without cutting the other thereof, and in the present embodiment, the print tape 417 is cut without cutting the release tape 419. Therefore, when the tape 413 is half-cut, a cut 425 (see FIG. 5) is formed in the print tape 417. A user can easily separate the print tape 417 and the release tape 419 by using the cut 425 as a clue.

A mounting mark 29 is provided on −X side of the cartridge mounting portion 7. The mounting mark 29 indicates mounting positions of the full-receiving portion 75, the full-movable portion 77, the half-receiving portion 79, and the half-movable portion 81.

A tape discharge portion 31 is provided between the cutter mounting portion 9 and the tape discharge port 11. After the tape 413 is cut by the full cutter 71, the tape discharge portion 31 discharges the cut tape 413 toward the tape discharge port 11.

Here, the tape cartridge 401 is mounted on the cartridge mounting portion 7 from the +Z side. Therefore, at the time of mounting the tape cartridge 401, the +Z side is open between the full-receiving portion 75 and the full-movable portion 77 so that the tape 413 fed from the tape cartridge 401 can be inserted between the full-receiving portion 75 and the full-movable portion 77 from the +Z side. Similarly, at the time of mounting the tape cartridge 401, the +Z side is open between the half-receiving portion 79 and the half-movable portion 81 so that the tape 413 fed from the tape cartridge 401 can be inserted between the half-receiving portion 79 and the half-movable portion 81 from the +Z side.

When the mounting portion lid 5 is closed after the tape cartridge 401 is mounted on the cartridge mounting portion 7, the print head 17 rotates around the head shaft 15 toward the platen shaft 23 by a head moving mechanism (not illustrated). Thereby, the tape 413 and the ink ribbon 421 are sandwiched between the print head 17 and the platen roller 405.

In this state, when a feed motor (not illustrated) rotates in a first direction, the platen roller 405 rotates and the tape 413 is fed toward the tape discharge port 11, and the take-up core 409 rotates and the ink ribbon 421 is taken up by the take-up core 409. At this time, when the print head 17 generates heat, print information input from a keyboard or the like is printed on the tape 413.

The printed portion of the tape 413 is cut off by the full cutter 71 and discharged from the tape discharge port 11 by the tape discharge portion 31. Thereafter, when the feed motor rotates in a second direction opposite to the first direction, the platen roller 405 reversely rotates and the tape 413 is pulled back, and the feeding core 407 rotates and the ink ribbon 421 is taken up by the feeding core 407. Thereby, the margin generated in the front in the length direction of the tape 413 to be printed next can be shortened.

Mounting Portion Cover

As illustrated in FIGS. 1 to 4, a lid-side head shaft support portion 33 and a lid-side platen shaft support portion 35 are provided on the inner surface of the mounting portion lid 5. In the following description, the Y direction of the mounting portion lid 5 means a Y direction in the state where the mounting portion lid 5 is closed.

The lid-side head shaft support portion 33 is formed in a substantially circular recessed shape. When the mounting portion lid 5 is closed, a +Z side end of the head shaft 15 is inserted into the lid-side head shaft support portion 33. The lid-side head shaft support portion 33 supports the +Z side end of the inserted head shaft 15.

The lid-side platen shaft support portion 35 is formed in a substantially circular recessed shape. When the mounting portion lid 5 is closed, a +Z side end of the platen shaft 23 is inserted into the lid-side platen shaft support portion 35. The lid-side platen shaft support portion 35 supports the +Z side end of the inserted platen shaft 23.

A lid-side full-receiving support portion 37, a lid-side full-movable support portion 39, a lid-side half-receiving support portion 41, a lid-side half-movable support portion 43, and a lid-side frame support portion 45 are provided on the inner surface of the mounting portion lid 5.

The lid-side full-receiving support portion 37 and the lid-side full-movable support portion 39 are integrally formed in a substantially rectangular recessed shape that is long in the Y direction. When the mounting portion lid 5 is closed, a full-receiving support target portion 155 of the full-receiving portion 75 is inserted into the lid-side full-receiving support portion 37 (see FIG. 33). The lid-side full-receiving support portion 37 supports the inserted full-receiving support target portion 155. The lid-side full-movable support portion 39 is provided on the −Y side of the lid-side full-receiving support portion 37. When the mounting portion lid 5 is closed, a full-movable second support target portion 189 of the full-movable portion 77 is inserted into the lid-side full-movable support portion 39 (see FIG. 33). The lid-side full-movable support portion 39 slidably supports the inserted full-movable second support target portion 189 in the Y direction, that is, in a contact/separation direction in which the full-movable portion 77 comes into contact with or separates from the full-receiving portion 75.

The lid-side half-receiving support portion 41 and the lid-side half-movable support portion 43 are provided on the −X side of the lid-side full-receiving support portion 37 and the lid-side full-movable support portion 39. The lid-side half-receiving support portion 41 and the lid-side half-movable support portion 43 are integrally formed in a substantially rectangular recessed shape that is bent in a crank shape and is long in the Y direction. When the mounting portion lid 5 is closed, a half-receiving support target portion 253 of the half-receiving portion 79 is inserted into the lid-side half-receiving support portion 41 (see FIG. 7). The lid-side half-receiving support portion 41 supports the inserted half-receiving support target portion 253. The lid-side half-movable support portion 43 is provided on the −Y side of the lid-side half-receiving support portion 41. When the mounting portion lid 5 is closed, a half-movable second support target portion 277 of the half-movable portion 81 is inserted into the lid-side half-movable support portion 43 (see FIG. 7). The lid-side half-movable support portion 43 slidably supports the inserted half-movable second support target portion 277 in the Y direction, that is, in a contact/separation direction in which the half-movable portion 81 comes into contact with or separates from the half-receiving portion 79.

The lid-side frame support portion 45 is provided on the −Y side of the lid-side half-movable support portion 43 and is formed in a substantially rectangular recessed shape. When the mounting portion lid 5 is closed, a +Z side end of a fourth frame portion 103 of a cutter frame 83 to be described later is inserted into the lid-side frame support portion 45 (see FIG. 19). The lid-side frame support portion 45 supports the +Z side end of the inserted fourth frame portion 103.

Cutter Mounting Portion

Figure 3:
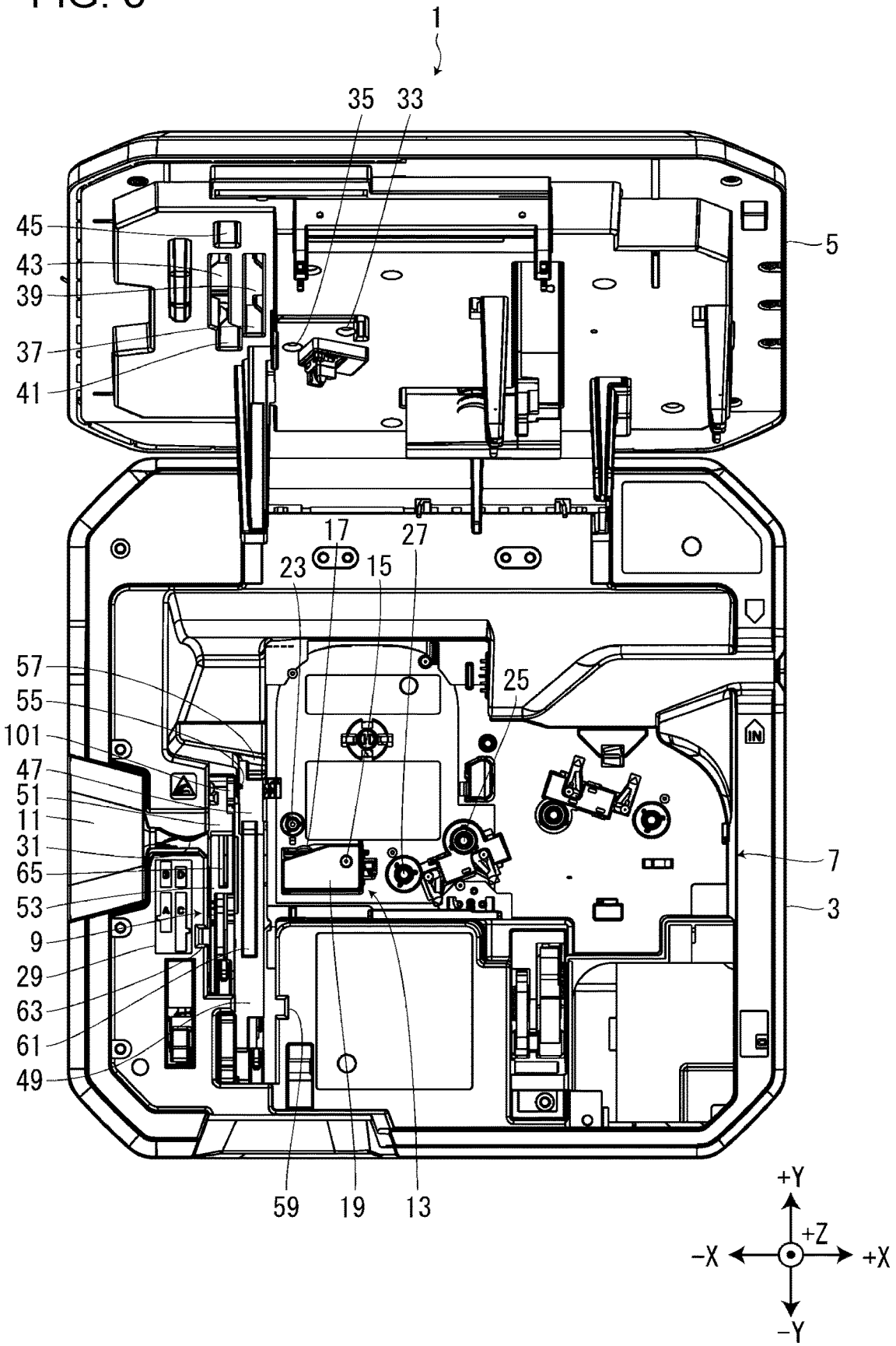
FIG. 3 is a view of the tape printing apparatus with the tape cartridge, the full cutter, and the half cutter removed, as viewed from the +Z side.
Figure 4:
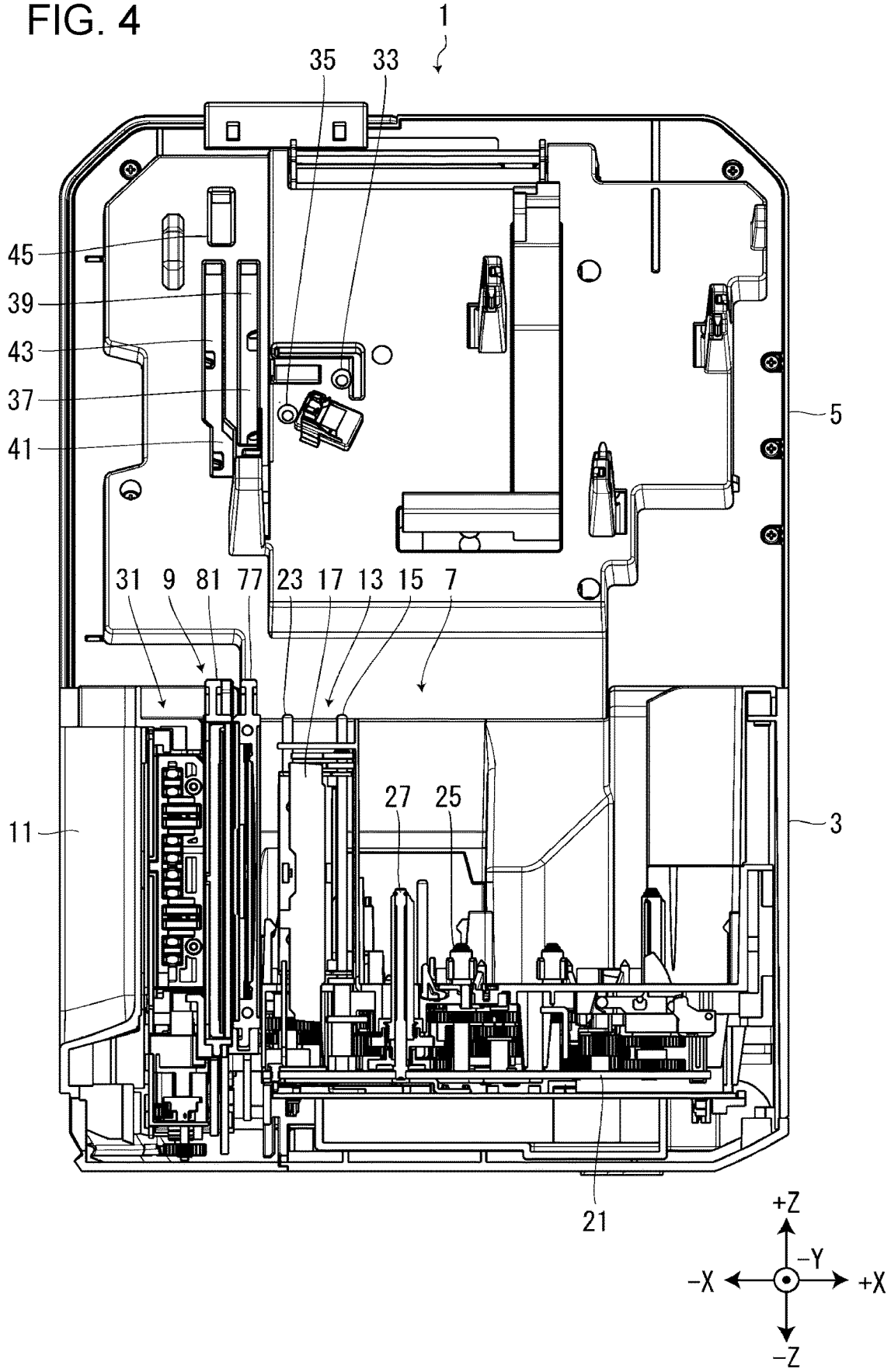
FIG. 4 is a sectional view of the tape printing apparatus viewed from the −Y side.

As illustrated in FIG. 3, the cutter mounting portion 9 includes a full-receiving mounting portion 47, a full-movable mounting portion 49, a half-receiving mounting portion 51, and a half-movable mounting portion 53.

The full-receiving portion 75 is detachably mounted on the full-receiving mounting portion 47. The full-receiving mounting portion 47 is provided with a full-receiving guide portion 55 and a full-receiving support portion 57. The full-receiving guide portion 55 is provided on an −X side surface of the full-receiving mounting portion 47 and is formed in a projecting shape extending in the Z direction (see FIG. 6). The full-receiving guide portion 55 is engaged with a full-receiving guide engaging portion (not illustrated) provided in the full-receiving portion 75 to guide the attachment and detachment of the full-receiving portion 75. The full-receiving support portion 57 is located on the +Y side, that is, on the opposite side of the full-movable portion 77 with respect to the mounted full-receiving portion 75. The full-receiving support portion 57 supports the full-receiving portion 75 pressed by the full-movable portion 77 from the −Y side.

Figure 10:
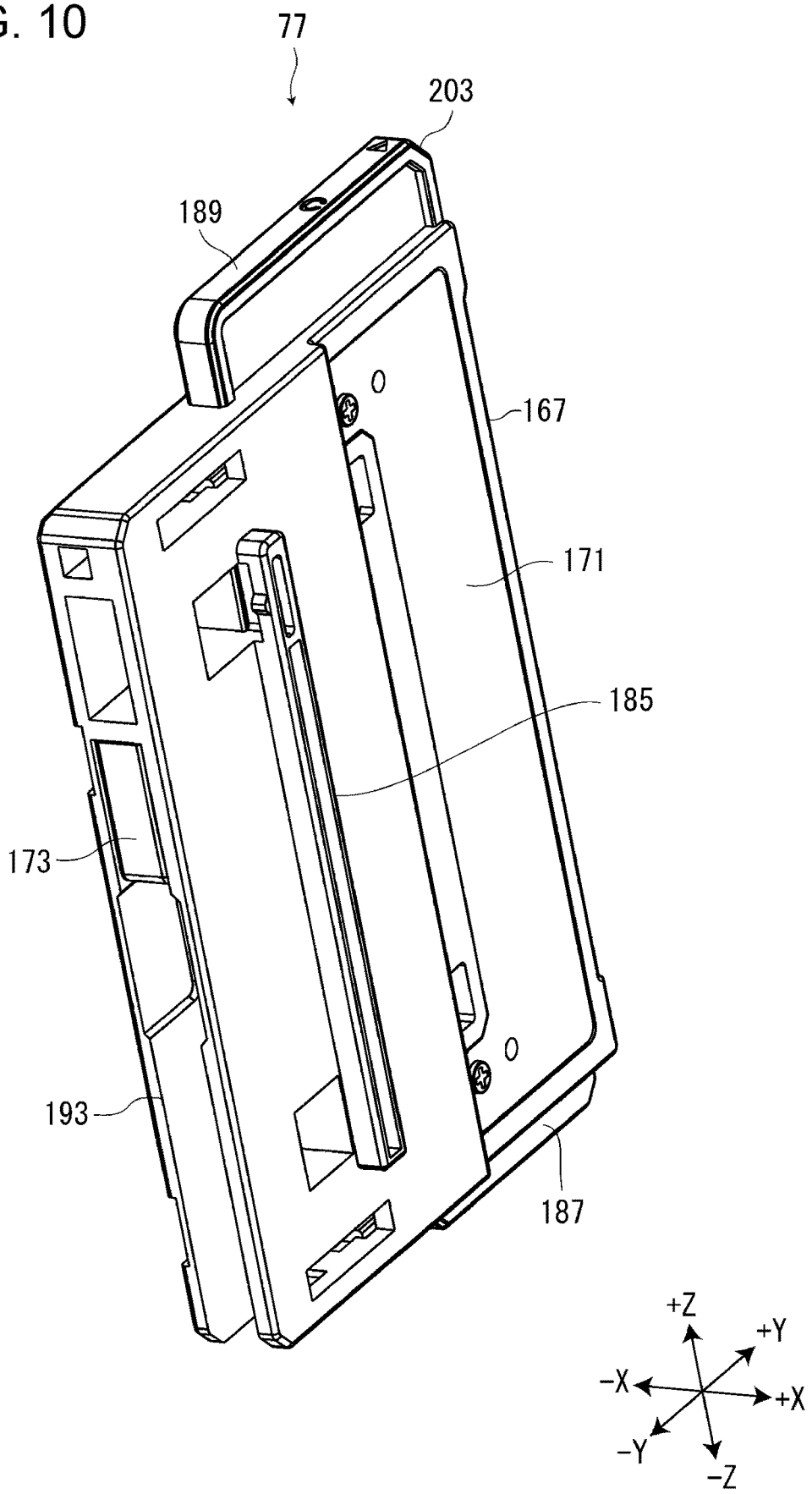
FIG. 10 is a perspective view of a full-movable portion.
Figure 11:
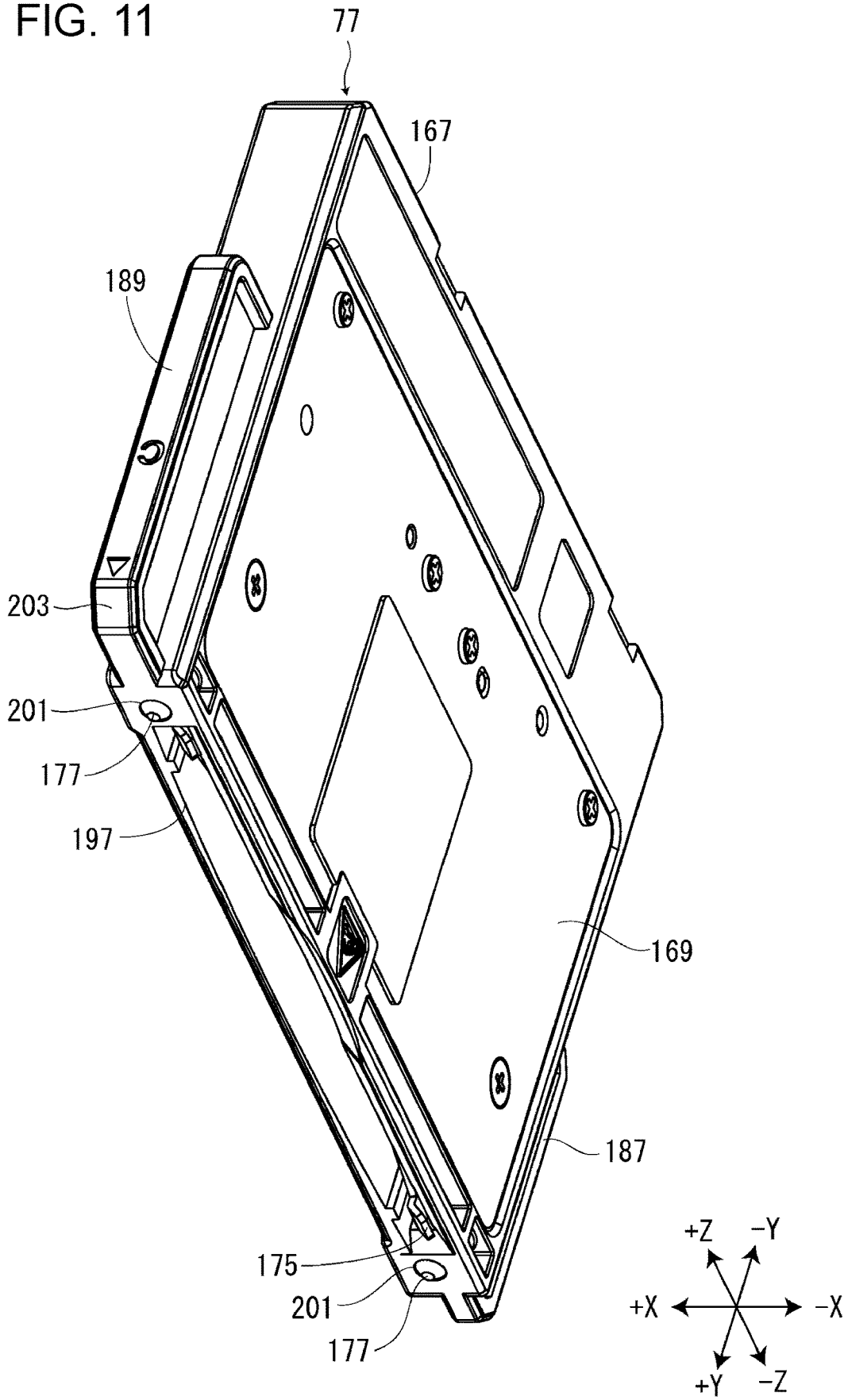
FIG. 11 is a perspective view of the full-movable portion viewed from an angle different from that in FIG. 10.
Figure 12:
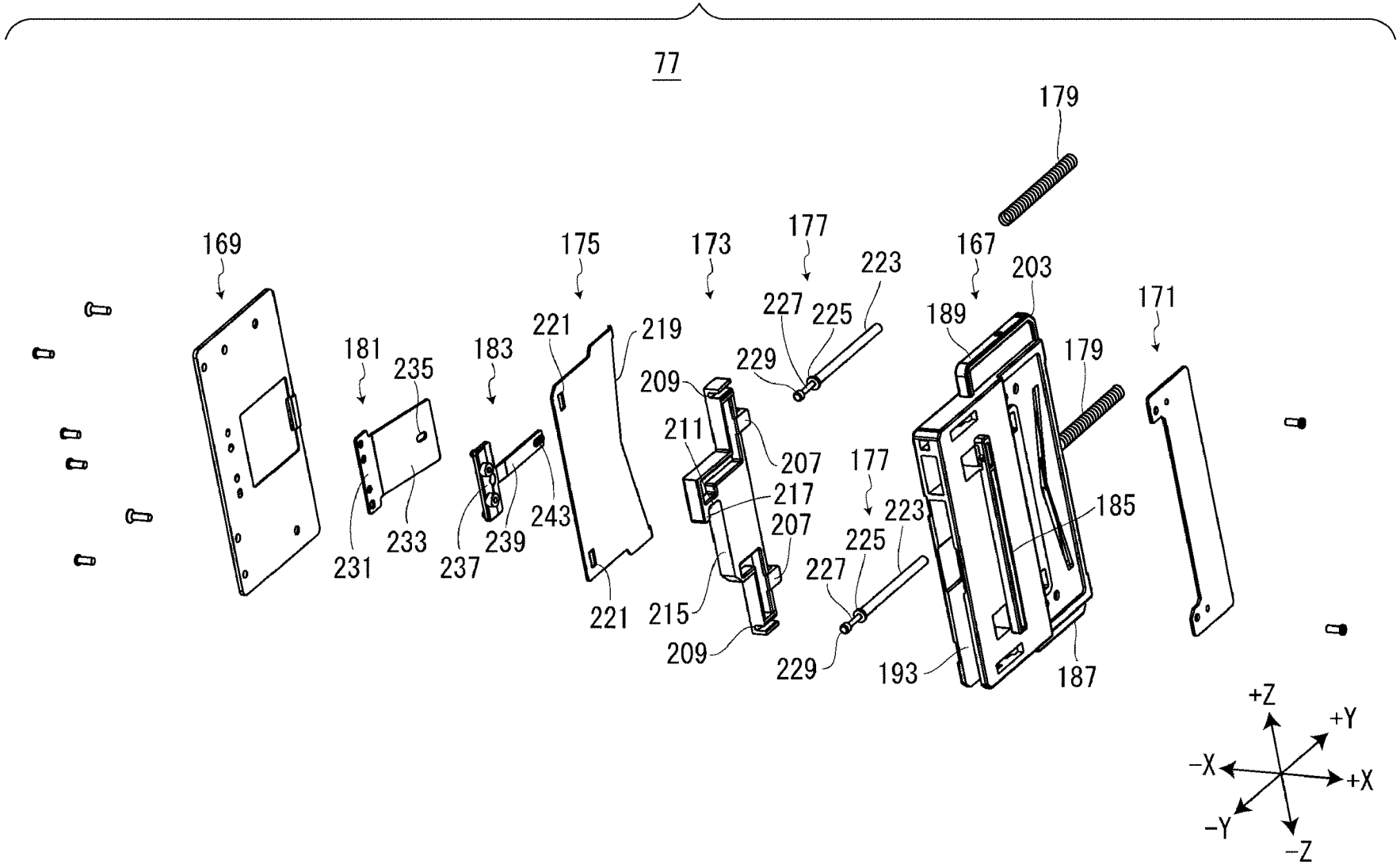
FIG. 12 is an exploded perspective view of the full-movable portion.
Figure 13:
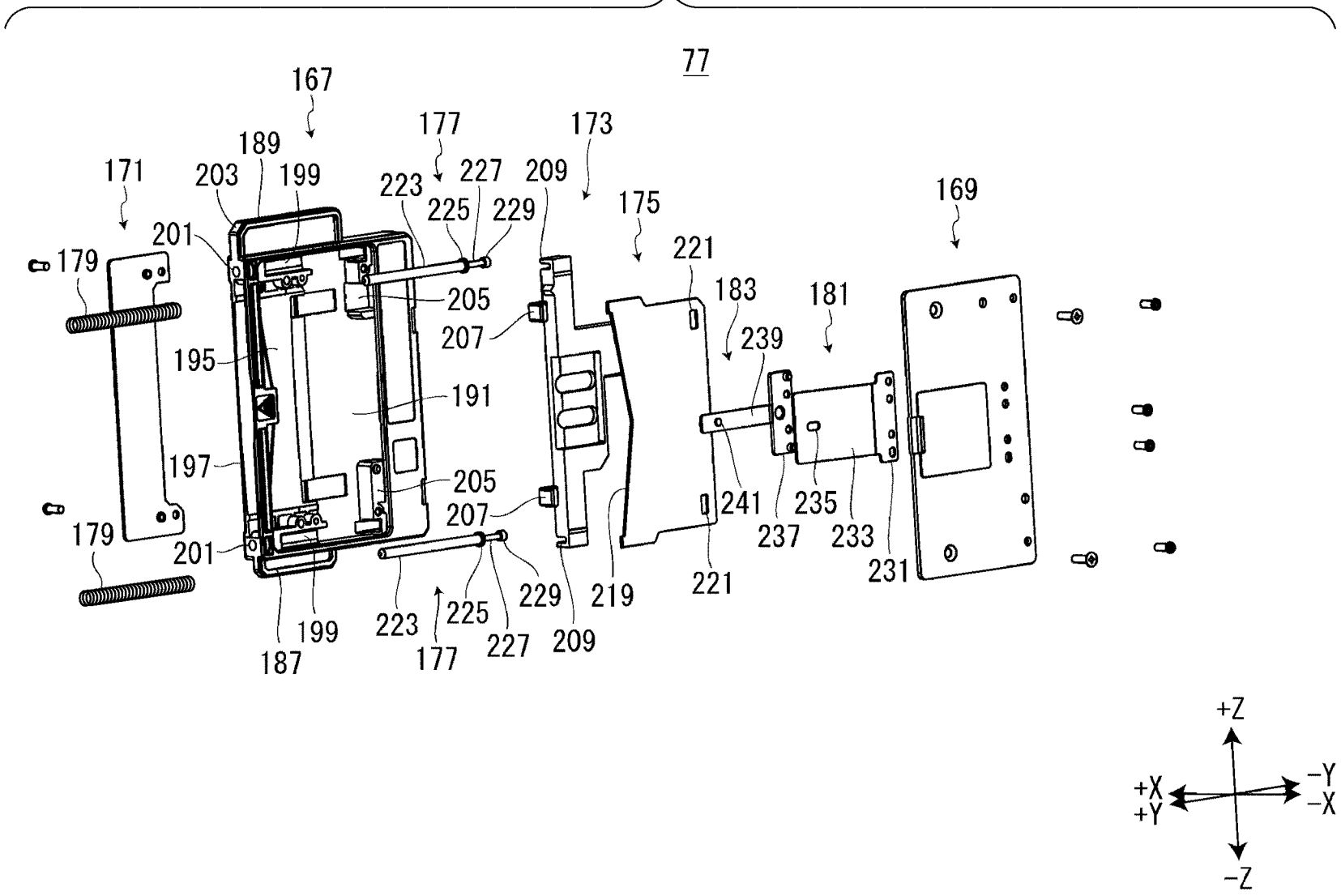
FIG. 13 is an exploded perspective view of the full-movable portion viewed from an angle different from that in FIG. 12.

The full-movable mounting portion 49 is provided on the −Y side of the full-receiving mounting portion 47. The full-movable portion 77 is detachably mounted on the full-movable mounting portion 49. The full-movable mounting portion 49 is provided with a full-movable guide portion 59 and a mounting-side full-movable support portion 61. The full-movable guide portion 59 is provided on a +X side surface of the full-movable mounting portion 49 and is formed in a groove shape extending in the Z direction. The full-movable guide portion 59 is engaged with a full-movable guide engaging portion 185 (see FIG. 10) provided in the full-movable portion 77 to guide the attachment and detachment of the full-movable portion 77. The mounting-side full-movable support portion 61 is provided on a −Z side surface of the full-movable mounting portion 49 and is formed in a groove shape extending in the Y direction. The mounting-side full-movable support portion 61 supports the full-movable portion 77 in a cantilever manner. That is, a full-movable first support target portion 187 provided in the full-movable portion 77 is inserted into the mounting-side full-movable support portion 61 (see FIG. 33). The mounting-side full-movable support portion 61 slidably supports the inserted full-movable first support target portion 187 in the Y direction, that is, in the contact/separation direction in which the full-movable portion 77 comes into contact with or separates from the full-receiving portion 75.

Note that, since the full-receiving portion 75 and the full-movable portion 77 are detachably mounted on the full-receiving mounting portion 47 and the full-movable mounting portion 49, respectively, when a cutting condition of the full cutter 71 is deteriorated, the cutting condition of the full cutter 71 can be recovered by replacing the full-receiving portion 75 and the full-movable portion 77 with new ones.

The half-receiving mounting portion 51 is provided on the −X side of the full-receiving mounting portion 47. The half-receiving portion 79 is detachably mounted on the half-receiving mounting portion 51. The half-receiving mounting portion 51 is provided with a third frame portion 101 of the cutter frame 83 to be described later. The third frame portion 101 is located on the +Y side, that is, on the opposite side of the half-movable portion 81 with respect to the mounted half-receiving portion 79. The third frame portion 101 supports the half-receiving portion 79 pressed by the half-movable portion 81 from the −Y side. The third frame portion 101 is an example of a "support portion".

The half-movable mounting portion 53 is provided on the −Y side of the half-receiving mounting portion 51. The half-movable portion 81 is detachably mounted on the half-receiving mounting portion 51. The half-movable mounting portion 53 is provided with a half-movable guide portion 63 and a mounting-side half-movable support portion 65. The half-movable guide portion 63 is provided on a −X side surface of the half-movable mounting portion 53 and is formed in a groove shape extending in the Z direction. The half-movable guide portion 63 is engaged with a half-movable guide engaging portion 273 (see FIG. 17) provided in the half-movable portion 81 to guide the attachment and detachment of the half-movable portion 81. The mounting-side half-movable support portion 65 is provided on a −Z side surface of the half-movable mounting portion 53 and is formed in a groove shape extending in the Y direction. The mounting-side half-movable support portion 65 supports the half-movable portion 81 in a cantilever manner. That is, a half-movable first support target portion 275 provided in the half-movable portion 81 is inserted into the mounting-side half-movable support portion 65 (see FIG. 7). The mounting-side half-movable support portion 65 slidably supports the inserted half-movable first support target portion 275 in the Y direction, that is, in the contact/separation direction in which the half-movable portion 81 comes into contact with or separates from the half-receiving portion 79.

Note that, since the half-receiving portion 79 and the half-movable portion 81 are detachably mounted on the half-receiving mounting portion 51 and the half-movable mounting portion 53, respectively, when a cutting condition of the half cutter 73 is deteriorated, the cutting condition of the half cutter 73 can be recovered by replacing the half-receiving portion 79 and the half-movable portion 81 with new ones.

Cutting Portion

As illustrated in FIG. 6, the cutting portion 67 includes a cutter drive portion 69, the full cutter 71, and the half cutter 73. As described above, the full cutter 71 includes the full-receiving portion 75 and the full-movable portion 77. The half cutter 73 includes the half-receiving portion 79 and the half-movable portion 81.

Cutter Drive Portion

Figure 7:
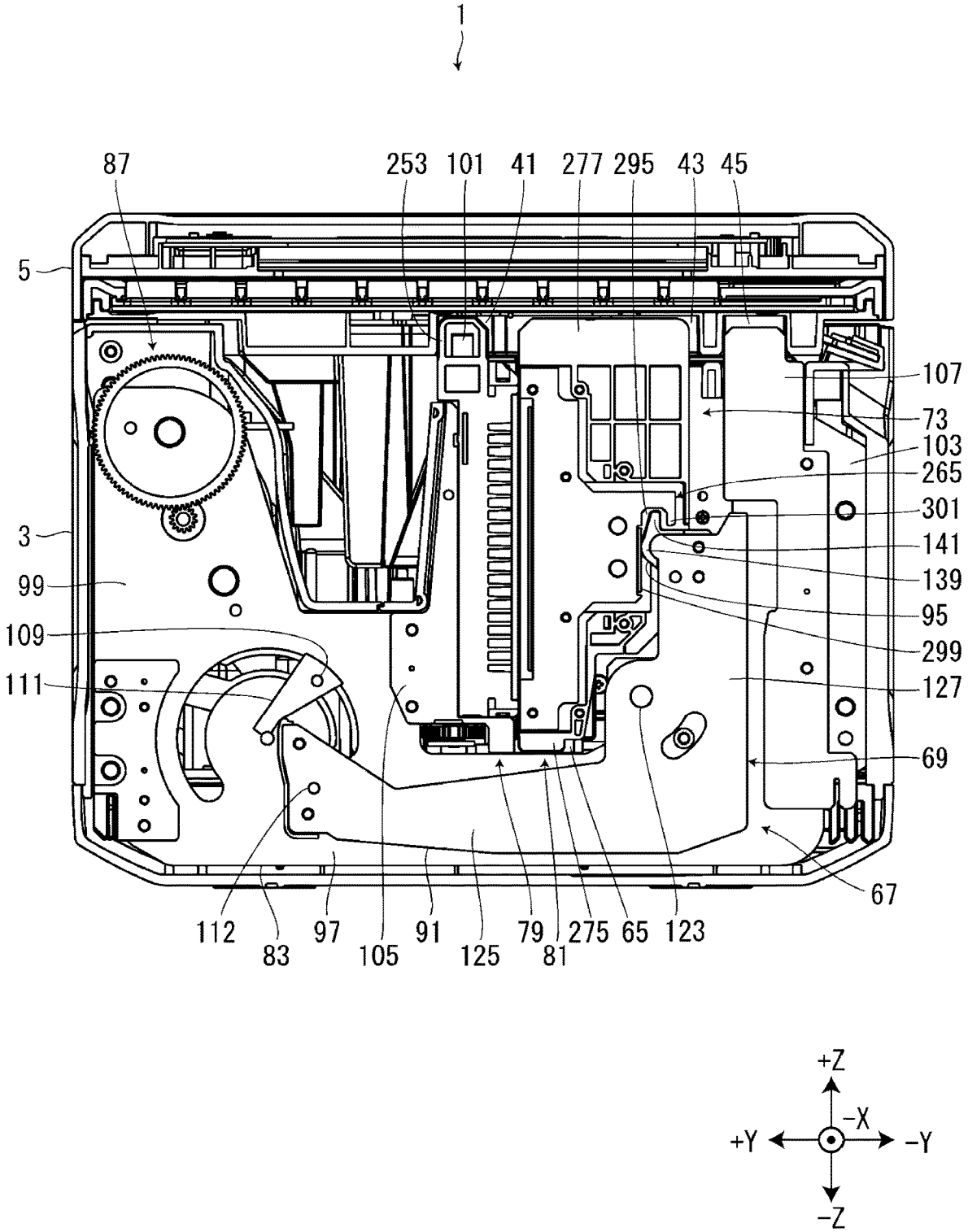
FIG. 7 is a sectional view of the tape printing apparatus viewed from the −X side, in a state where a half-movable portion approaches a half-receiving portion.

The cutter drive portion 69 drives the full-movable portion 77 and the half-movable portion 81. As illustrated in FIGS. 6 and 7, the cutter drive portion 69 includes the cutter frame 83, a cutter motor 85, a cutter gear train 87, a full lever 89, a half lever 91, a full-pressing portion 93, and a half-pressing portion 95.

The cutter frame 83 is a metal plate material provided substantially parallel to the YZ plane, and includes a first frame portion 97, a second frame portion 99, the third frame portion 101, and the fourth frame portion 103. The first frame portion 97 is located at a −Z side end of the cutter frame 83, and extends in the Y direction. The second frame portion 99, the third frame portion 101, and the fourth frame portion 103 project from the first frame portion 97 to the +Z side. The second frame portion 99, the third frame portion 101, and the fourth frame portion 103 are provided in this order from the +Y side.

A first frame attachment member 105 made of resin is attached on a −X side surface of the third frame portion 101. A second frame attachment member 107 made of resin is attached on a −X side surface of the fourth frame portion 103. The second frame attachment member 107 covers the +Z side end of the fourth frame portion 103. Therefore, when the +Z side end of the fourth frame portion 103 is inserted into the lid-side frame support portion 45, the lid-side frame support portion 45 is suppressed from being scratched.

The cutter motor 85 is attached to the second frame portion 99. The cutter motor 85 is a drive source of the full-movable portion 77 and the half-movable portion 81.

The cutter gear train 87 is attached to the second frame portion 99. The cutter gear train 87 transmits the power input from the cutter motor 85 to the full lever 89 and the half lever 91. A drive projecting portion 111 having a substantially fan shape is provided on a +X side end surface of an output gear (not illustrated) of the cutter gear train 87. A drive projection 109 is fixed to a portion near the radial outside of the drive projecting portion 111.

The full lever 89 is provided on the +X side of the first frame portion 97 and the fourth frame portion 103. The full lever 89 is formed in a substantially "L" shape as a whole. The full lever 89 is swingably supported by a full swing shaft 113 provided at a −Y side end of the first frame portion 97. The full lever 89 includes a full first lever portion 115 extending in the Y direction, and a full second lever portion 117 extending from a −Y side end of the full first lever portion 115 to the +Z side. A drive slot 119 is provided at a +Y side end of the full first lever portion 115. The drive projection 109 is inserted into the drive slot 119. The full-pressing portion 93 is fixed to a +Z side end of the full second lever portion 117.

The half lever 91 is provided on the −X side of the first frame portion 97 and the fourth frame portion 103. The half lever 91 is formed in a substantially "L" shape. The half lever 91 is swingably supported by a half swing shaft 123 provided at a −Z side end of the fourth frame portion 103. The half lever 91 includes a half first lever portion 125 extending in the Y direction, and a half second lever portion 127 extending from a −Y side end of the half first lever portion 125 to the +Z side. The half-pressing portion 95 is fixed to a +Z side end of the half second lever portion 127.

The full-pressing portion 93 includes a full first pressing portion 131 and a full second pressing portion 133. The full first pressing portion 131 is attached to the +Z side end of the full second lever portion 117. The full second pressing portion 133 projects from the full first pressing portion 131 to the +Z side.

The half-pressing portion 95 includes a half first pressing portion 139 and a half second pressing portion 141. The half first pressing portion 139 is attached to the +Z side end of the half second lever portion 127. The half second pressing portion 141 projects from the half first pressing portion 139 to the +Z side.

When the drive projection 109 reciprocates between a home position (see FIG. 34) and a first drive position (see FIG. 33), the cutter drive portion 69 configured as described above drives the full-movable portion 77 without driving the half-movable portion 81. When the drive projection 109 reciprocates between a home position (see FIG. 19) and a second drive position (see FIG. 7), the cutter drive portion 69 drives the half-movable portion 81 without driving the full-movable portion 77.

That is, when the drive projection 109 moves from the home position (see FIG. 34) to the first drive position (see FIG. 33), the full lever 89 rotates clockwise as viewed from the +X side, and the full-pressing portion 93 moves to the +Y side. Thereby, the full-pressing portion 93 presses the full-movable portion 77 to the +Y side, that is, toward the full-receiving portion 75. When the drive projection 109 moves from the first drive position to the home position, the full lever 89 rotates counterclockwise as viewed from the +X side, and the full-pressing portion 93 moves to the −Y side. Thereby, the full-pressing portion 93 pulls the full-movable portion 77 to the −Y side, that is, toward the side opposite to the full-receiving portion 75.

Meanwhile, when the drive projection 109 moves from the home position (see FIG. 19) to the second drive position (see FIG. 7), the half lever 91 is pushed by the drive projecting portion 111, so that the half lever 91 rotates clockwise as viewed from the +X side, and the half-pressing portion 95 moves to the +Y side. Thereby, the half-pressing portion 95 presses the half-movable portion 81 to the +Y side, that is, toward the half-receiving portion 79. When the drive projection 109 moves from the second drive position to the home position, a return pin 112 is engaged with a return engaging portion (not illustrated) provided on the +X side end surface of the output gear, so that the half lever 91 rotates counterclockwise as viewed from the +X side, and the half-pressing portion 95 moves to the −Y side. Thereby, the half-pressing portion 95 presses the half-movable portion 81 to the −Y side, that is, toward the side opposite to the half-receiving portion 79.

Full-Receiving Portion

Figure 8:
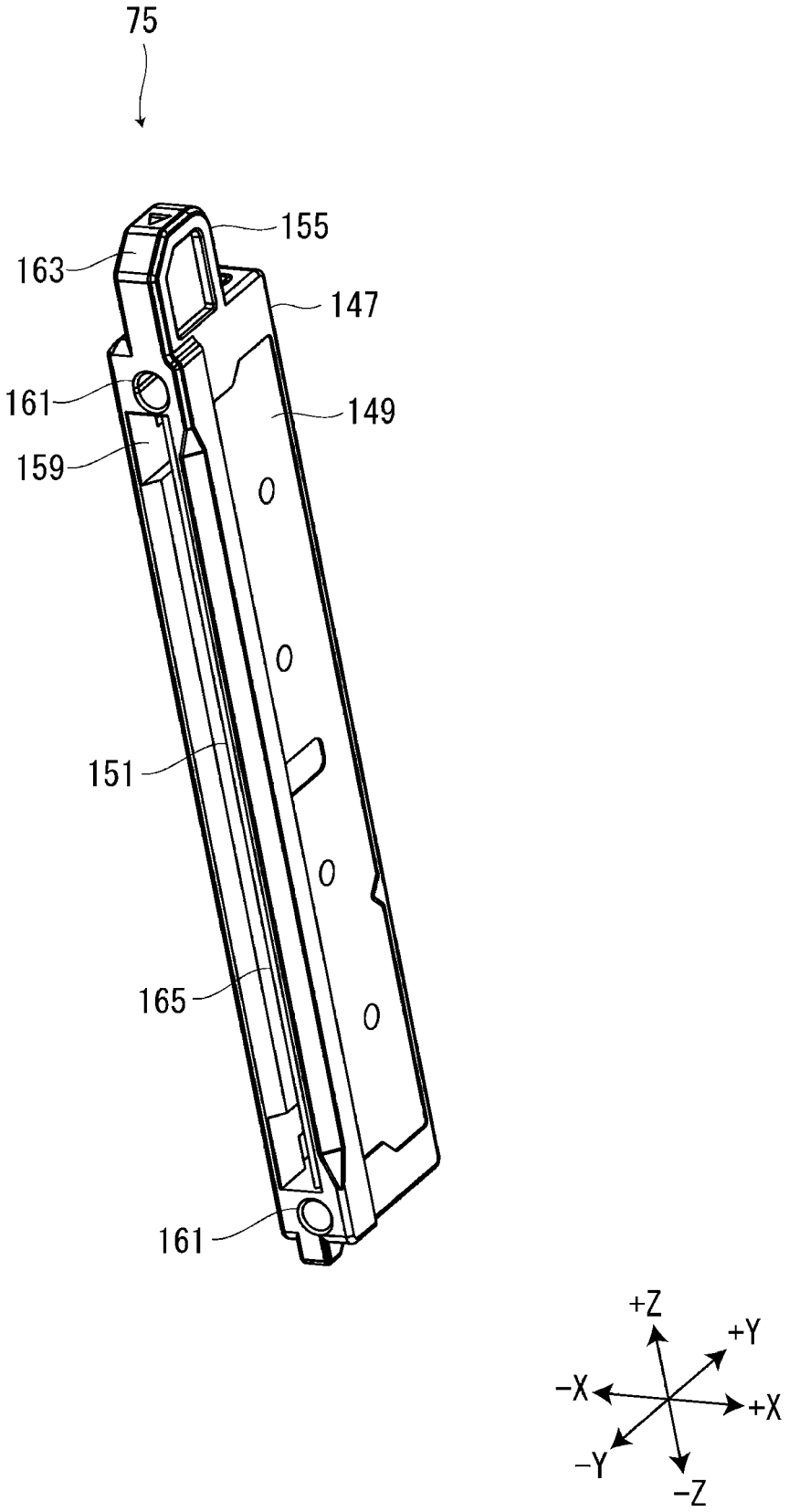
FIG. 8 is a perspective view of a full-receiving portion.
Figure 9:
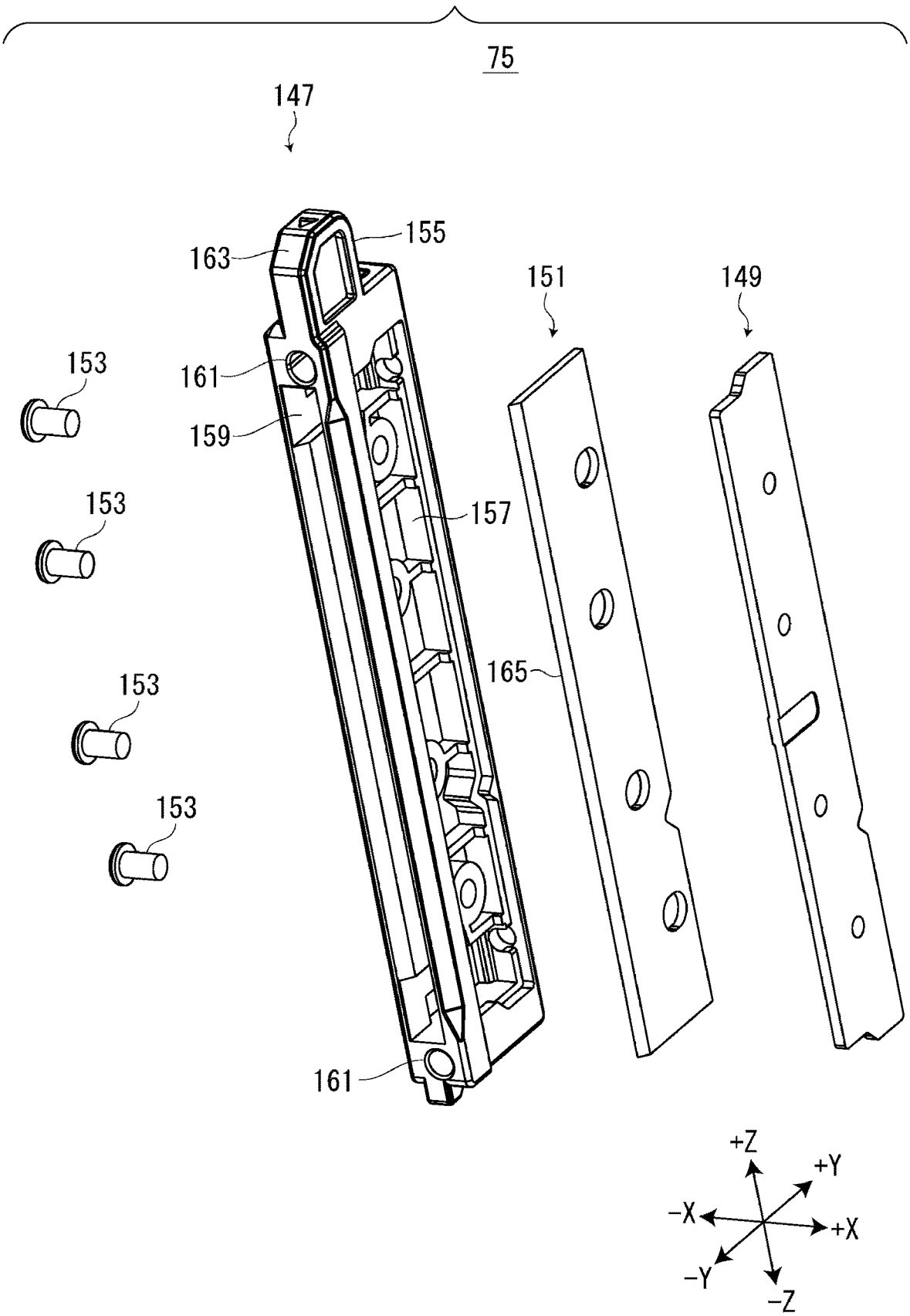
FIG. 9 is an exploded perspective view of the full-receiving portion.

As illustrated in FIGS. 8 and 9, the full-receiving portion 75 includes a full-receiving case 147, a full-receiving case cover 149, and a full-receiving blade 151.

The full-receiving case 147 accommodates the full-receiving blade 151. The full-receiving case 147 is provided with a full-receiving guide engaging portion (not illustrated), the full-receiving support target portion 155, a full-receiving blade attachment portion 157, a blade entrance 159, and two positioning holes 161.

The full-receiving guide engaging portion is provided on an −X side surface of the full-receiving case 147 and is formed in a groove shape extending in the Z direction. The full-receiving guide engaging portion is engaged with the full-receiving guide portion 55 provided in the full-receiving mounting portion 47 to guide the attachment and detachment of the full-receiving portion 75.

The full-receiving support target portion 155 is provided at a +Z side end of the full-receiving case 147 and is formed in a projecting shape. When the mounting portion lid 5 is closed, the full-receiving support target portion 155 is inserted into the lid-side full-receiving support portion 37 and is supported by the lid-side full-receiving support portion 37 (see FIG. 33). The full-receiving support target portion 155 is pinched by the user when the full-receiving portion 75 is attached or detached. The full-receiving case 147 is provided with a full-receiving tape guide portion 163 so as to chamfer the −Y side corner of the full-receiving support target portion 155. At the time of mounting the tape cartridge 401, the full-receiving tape guide portion 163 guides the tape 413 fed from the tape cartridge 401 between the full-receiving portion 75 and the full-movable portion 77.

The full-receiving blade 151 is attached to the full-receiving blade attachment portion 157. The +X side of the full-receiving blade attachment portion 157 is open, and after the full-receiving blade 151 is mounted, the open portion is closed by the full-receiving case cover 149.

The blade entrance 159 is provided on a −Y side surface of the full-receiving case 147 and is formed in a substantially rectangular shape that is long in the Z direction. A full-movable blade 175 of the full-movable portion 77 retracts into the full-receiving case 147 through the blade entrance 159 (see FIG. 24).

The two positioning holes 161 are provided on the +Z side and −Z side of the blade entrance 159, on the −Y side surface of the full-receiving case 147. That is, the two positioning holes 161 are disposed so as to sandwich the full-receiving blade 151 in the Z direction. The positioning holes 161 extend in the Y direction, that is, the direction in which the full-movable portion 77 comes into contact with or separates from the full-receiving portion 75. When the full-movable portion 77 moves toward the full-receiving portion 75, positioning pins 177 of the full-movable portion 77 are inserted into the positioning holes 161 (see FIG. 24).

The full-receiving blade 151 is fixed between the full-receiving case 147 and the full-receiving case cover 149 by full fixing screws 153. When the full-movable portion 77 moves toward the full-receiving portion 75, the full-receiving blade 151 overlaps and rubs against the full-movable blade 175 that has retracted through the blade entrance 159 in the X direction, so that the tape 413 is fully cut. In a state where the full-receiving blade 151 and the full-movable blade 175 overlap, the full-receiving blade 151 is located on the +X side, and the full-movable blade 175 is located on the −X side (see FIG. 24). The full-receiving blade 151 is formed in a substantially rectangular plate shape. A full-receiving blade tip 165 is provided on a −Y side edge of the full-receiving blade 151. The full-receiving blade tip 165 is formed in a substantially linear shape, and extends in the Z direction. That is, the blade length direction of the full-receiving blade 151 is the Z direction.

Full-Movable Portion

As illustrated in FIGS. 10 to 13, the full-movable portion 77 includes a full-movable case 167, a full-movable first case cover 169, a full-movable second case cover 171, a full-movable holder 173, and the full-movable blade 175. The full-movable portion 77 includes two positioning pins 177, two full return springs 179, a blade pressing spring 181, a blade pressing member 183.

The full-movable case 167 accommodates the full-movable blade 175 so as to project and retract. The full-movable case 167 is provided with the full-movable guide engaging portion 185, the full-movable first support target portion 187, and the full-movable second support target portion 189. The full-movable case 167 is provided with a full-movable holder accommodating portion 191, a full drive opening 193, a full-movable blade accommodating portion 195, a full blade entrance 197, two pin accommodating portions 199, and two pin entrances 201.

The full-movable guide engaging portion 185 is provided on a +X side surface of the full-movable case 167 and is formed in a projecting shape extending in the Z direction. The full-movable guide engaging portion 185 is engaged with the full-movable guide portion 59 provided in the full-movable mounting portion 49 to guide the attachment and detachment of the full-movable portion 77.

The full-movable first support target portion 187 is provided at a −Z side end of the full-movable case 167 and is formed in a projecting shape extending in the Y direction. When the full-movable portion 77 is mounted on the full-movable mounting portion 49, the full-movable first support target portion 187 is inserted into the mounting-side full-movable support portion 61, and is slidably supported by the mounting-side full-movable support portion 61 in the Y direction. (see FIG. 33).

The full-movable second support target portion 189 is provided at a +Z side end of the full-movable case 167 and is formed in a projecting shape extending in the Y direction. When the mounting portion lid 5 is closed, the full-movable second support target portion 189 is inserted into the lid-side full-movable support portion 39 and is slidably supported by the lid-side full-movable support portion 39 in the Y direction (see FIG. 33). The full-movable second support target portion 189 is pinched by the user when the full-movable portion 77 is attached or detached. The full-movable case 167 is provided with a full-movable tape guide portion 203 so as to chamfer the +Y side corner of the full-movable second support target portion 189. When the tape cartridge 401 is mounted, the full-movable tape guide portion 203 guides the tape 413 fed from the tape cartridge 401 between the full-receiving portion 75 and the full-movable portion 77.

The full-movable holder accommodating portion 191 is provided at a substantially half portion on the −Y side of the full-movable case 167. The full-movable holder 173 is slidably accommodated in the full-movable holder accommodating portion 191 in the Y direction. The full-movable holder accommodating portion 191 is provided with two full abutment portions 205. When the full-movable holder 173 moves to the −Y side with respect to the full-movable case 167, the full-movable holder 173 abuts on the two full abutment portions 205 (see FIG. 26).

The full drive opening 193 is provided on a −Y side surface of the full-movable case 167. The full-pressing portion 93 of the cutter drive portion 69 is engaged with the full-movable holder 173 accommodated in the full-movable holder accommodating portion 191 through the full drive opening 193.

The full-movable blade accommodating portion 195 is provided at a substantially half portion on the +Y side of the full-movable case 167. The full-movable blade 175 is slidably accommodated in the full-movable blade accommodating portion 195 in the Y direction. The −X side of the full-movable blade accommodating portion 195 is open, and after the full-movable blade 175 is mounted, the open portion is closed by the full-movable first case cover 169. The full-movable second case cover 171 is attached to the +X side of the full-movable blade accommodating portion 195.

The full blade entrance 197 is provided on a +Y side surface of the full-movable case 167 and is formed in a substantially rectangular shape that is long in the Z direction. The full-movable blade 175 accommodated in the full-movable case 167 projects from and retracts into the full blade entrance 197.

The two pin accommodating portions 199 are provided at the +Z side end and the −Z side end of the full-movable case 167. The positioning pin 177 is slidably accommodated in the pin accommodating portion 199 in the Y direction.

The two pin entrances 201 are provided on the +Z side and −Z side of the full blade entrance 197, on the +Y side surface of the full-movable case 167. The positioning pin 177 accommodated in the pin accommodating portion 199 projects from and retracts into the pin entrance 201.

The full-movable holder 173 is accommodated in the full-movable holder accommodating portion 191. The full-movable holder 173 holds the full-movable blade 175 and the two positioning pins 177. The full-movable holder 173 is reciprocated in the Y direction by being pressed and pulled by the full-pressing portion 93 of the cutter drive portion 69, and allows the held full-movable blade 175 and two positioning pins 177 to reciprocate in the Y direction. Thereby, the full-movable blade 175 projects from and retracts into the full-movable case 167 in conjunction with the two positioning pins 177.

The full-movable holder 173 includes two blade-engaging claws 207, two pin-engaging recessed portions 209, and a full-pressing recessed portion 211.

The two blade-engaging claws 207 are provided at a +Y side end of the full-movable holder 173, and are separated from each other in the Z direction. The two blade-engaging claws 207 are engaged with two blade-engaging holes 221 provided in the full-movable blade 175 from the +X side. Thereby, the full-movable blade 175 is held by the full-movable holder 173.

The two pin-engaging recessed portions 209 are provided at a +Z side end and a −Z side end of the full-movable holder 173. The two pin-engaging recessed portions 209 are engaged with thin diameter portions 227 provided in the two positioning pins 177. Thereby, the two positioning pins 177 are supported by the full-movable holder 173.

The full-pressing recessed portion 211 is provided at a −Y side end of the full-movable holder 173, and is formed in a recessed shape with the +X side and the −Z side open. The full-pressing recessed portion 211 extends in the Y direction, that is, the direction in which the full-movable portion 77 comes into contact with or separates from the full-receiving portion 75. The full second pressing portion 133 of the full-pressing portion 93 is inserted into the full-pressing recessed portion 211 (see FIG. 33). The full second pressing portion 133 moves in the full-pressing recessed portion 211 in the Y direction as the full lever 89 swings.

The full-movable holder 173 includes a full first pressing target portion 215 and a full second pressing target portion 217. The full first pressing target portion 215 is a portion that is pressed to the +Y side by the full first pressing portion 131, and is constituted by a −Y side end surface of the full-movable holder 173. The full second pressing target portion 217 is a portion that engages with the full second pressing portion 133 projecting to the +Z side and is pulled to the −Y side, and is constituted by a −Y side wall portion of the full-pressing recessed portion 211.

The full-movable blade 175 is held by the full-movable holder 173. When the full-movable holder 173 moves toward the full-receiving portion 75, the full-movable blade 175 projects from the full blade entrance 197 and overlaps and rubs against the full-receiving blade 151 in the X direction, so that the tape 413 is fully cut. The full-movable blade 175 is formed in a substantially rectangular plate shape. A full-movable blade tip 219 is provided on a +Y side edge of the full-movable blade 175. The full-movable blade tip 219 is formed in a substantially "V" shape, and extends in the Z direction. That is, the blade length direction of the full-movable blade 175 is the Z direction. The two blade-engaging holes 221 separated from each other in the Z direction are provided at a −Y side end of the full-movable blade 175. The two blade-engaging claws 207 provided in the full-movable holder 173 are engaged with the two blade-engaging holes 221.

The two positioning pins 177 are held by the full-movable holder 173. When the full-movable holder 173 moves toward the full-receiving portion 75, the two positioning pins 177 are inserted into the two positioning holes 161 provided in the full-receiving case 147, thereby positioning the full-receiving portion 75 in the X direction with respect to the full-movable portion 77. The positioning pin 177 is slidably accommodated in the pin accommodating portion 199 in the Y direction. The two positioning pins 177 are respectively disposed on the +Z side and the −Z side so as to sandwich the full-movable blade 175 in the Z direction. The positioning pins 177 extend in the Y direction, that is, the direction in which the full-movable portion 77 comes into contact with or separates from the full-receiving portion 75.

The positioning pin 177 is formed in a substantially columnar shape that is long in the Y direction as a whole, and includes a spring mounting portion 223, a thick diameter portion 225, the thin diameter portion 227, and a base end portion 229 in order from the +Y side. The full return spring 179 is provided on the outer peripheral side of the spring mounting portion 223. The thick diameter portion 225 is formed thicker than the spring mounting portion 223. The thin diameter portion 227 is formed thinner than the spring mounting portion 223. The thin diameter portion 227 is engaged with the pin-engaging recessed portion 209 provided in the full-movable holder 173. The base end portion 229 has substantially the same diameter as the spring mounting portion 223.

The two full return springs 179 are accommodated in the two pin accommodating portions 199 together with the two positioning pins 177. As the full return spring 179, for example, a compression coil spring can be used. The spring mounting portion 223 of the positioning pin 177 is inserted into the full return spring 179, and is provided between a +Y side wall portion of the pin accommodating portion 199 and the thick diameter portion 225 of the positioning pin 177. Therefore, the full return spring 179 is compressed when the positioning pin 177 moves to the +Y side and projects from the pin entrance 201. The full return spring 179 applies a force to the positioning pin 177, the full-movable holder 173, and the full-movable blade 175 toward −Y side, that is, the side opposite to the full-receiving portion 75.

The blade pressing spring 181 is provided between the full-movable first case cover 169 and the full-movable blade 175. The blade pressing spring 181 presses the full-movable blade 175 toward the +X side, that is, the full-receiving blade 151 when the full-receiving blade 151 and the full-movable blade 175 overlap and rub against each other. Thereby, the full-movable blade 175 appropriately rubs against the full-receiving blade 151 while flexing, so that the tape 413 can be appropriately sheared.

As the blade pressing spring 181, for example, a plate spring can be used. The blade pressing spring 181 is formed in a substantially rectangular plate shape as a whole, and includes a spring attachment portion 231 and a spring pressing portion 233. The spring attachment portion 231 is provided at a −Y side end of the blade pressing spring 181, and is a portion to be attached to the full-movable first case cover 169. A spring-engaging hole 235 is provided at a +Y side end of the spring pressing portion 233. The spring-engaging hole 235 is engaged with a spring-engagement projecting portion 241 provided on the blade pressing member 183.

The blade pressing member 183 is provided between the blade pressing spring 181 and the full-movable blade 175. The blade pressing member 183 receives an elastic force from the blade pressing spring 181 and presses the full-movable blade 175 to the +X side. The blade pressing member 183 is made of resin. The blade pressing spring 181 presses the full-movable blade 175 through the blade pressing member 183. Therefore, it is possible to suppress that the full-movable blade 175 and the blade pressing spring 181, both of which are made of metal, directly rub against each other and the full-movable blade 175 is scratched.

The blade pressing member 183 is formed in a substantially "T" shape as a whole, and includes a member attachment portion 237 and a projecting portion-forming portion 239. The member attachment portion 237 extends in the Z direction, and is a portion to be attached to the full-movable first case cover 169 through the spring attachment portion 231. The projecting portion-forming portion 239 extends in the Y direction, and at a +Y side end of the projecting portion-forming portion 239, the spring-engagement projecting portion 241 is provided on a −X side surface thereof and a blade pressing-projecting portion 243 is provided on a +X side surface thereof. The spring-engagement projecting portion 241 is engaged with the spring-engaging hole 235 provided on the blade pressing spring 181. The blade pressing-projecting portion 243 contacts the full-movable blade 175 and presses the full-movable blade 175 to the +X side.

Instead of the full-movable portion 77 including the blade pressing spring 181, the full-receiving portion 75 may include a blade pressing spring that presses the full-receiving blade 151 toward the full-movable blade 175 when the full-receiving blade 151 and the full-movable blade 175 overlap and rub against each other.

Half-Receiving Portion

Figure 14:
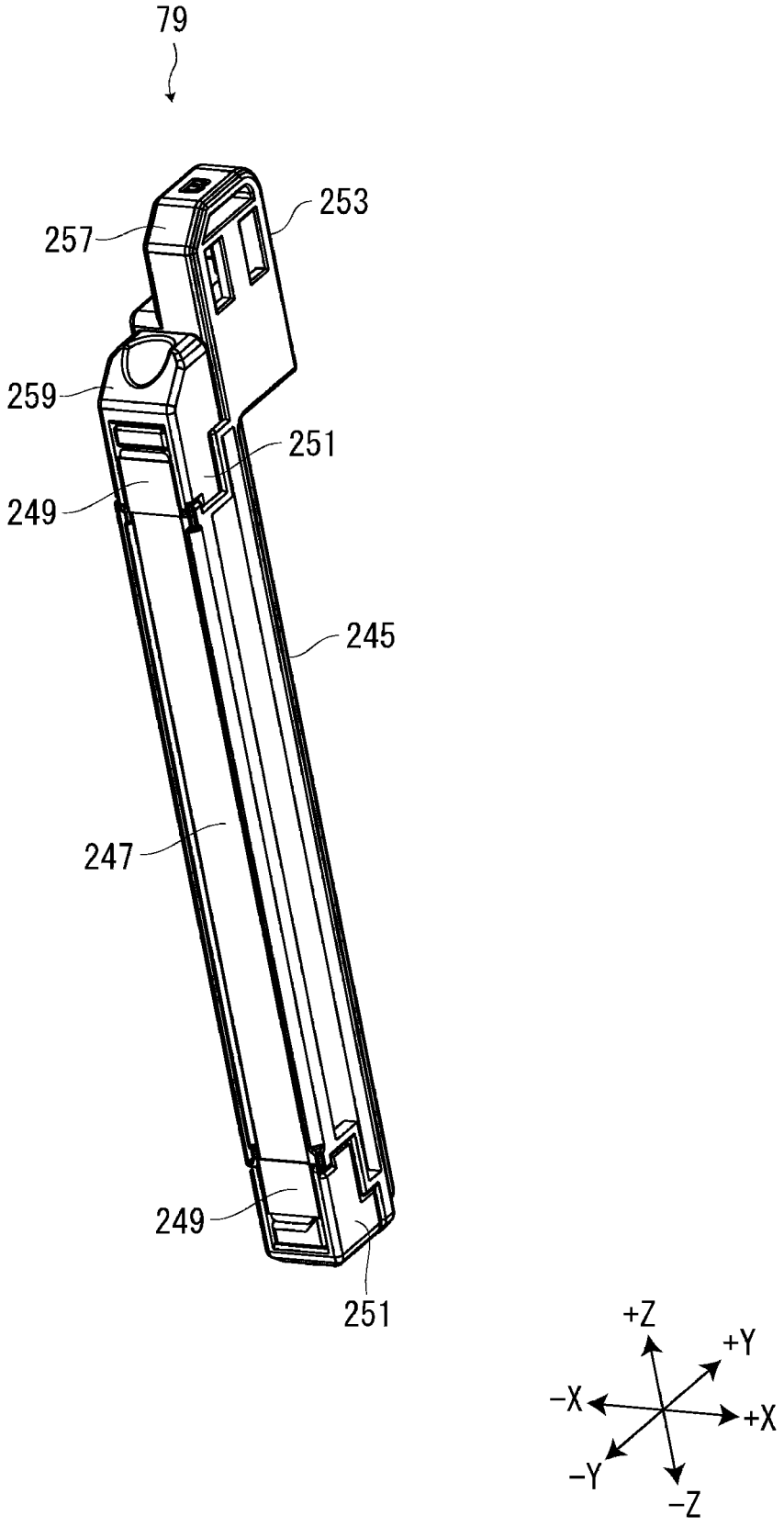
FIG. 14 is a perspective view of the half-receiving portion.
Figure 15:
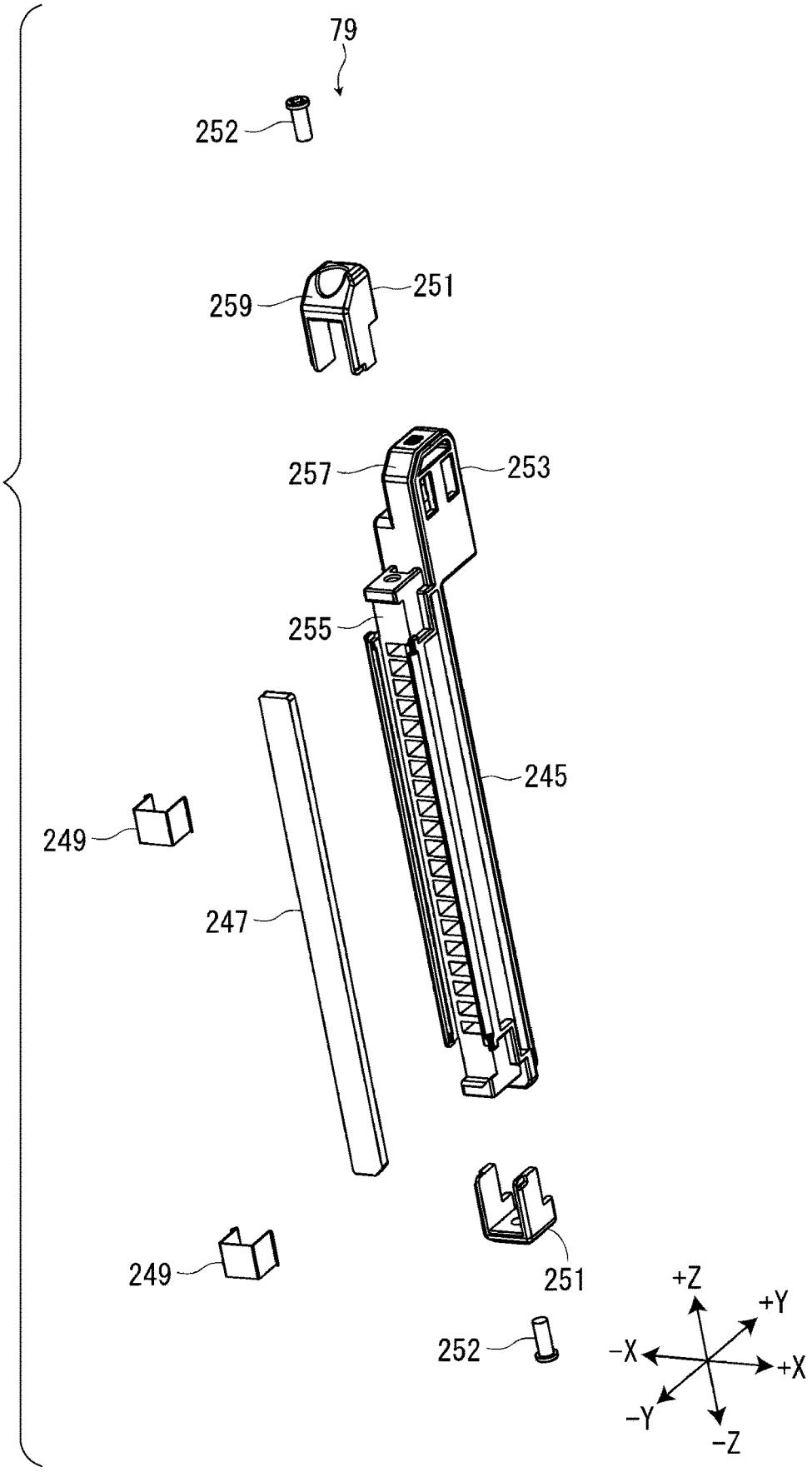
FIG. 15 is an exploded perspective view of the half-receiving portion.

As illustrated in FIGS. 14 and 15, the half-receiving portion 79 includes a half-receiving case 245, a blade-receiving member 247, two spacers 249, and two fixing members 251.

The blade-receiving member 247 is fixed to the half-receiving case 245. The half-receiving case 245 is provided with the half-receiving support target portion 253, and a blade-receiving attachment recessed portion 255.

The half-receiving support target portion 253 is provided at a +Z side end of the half-receiving case 245 and is formed in a projecting shape. When the half-receiving portion 79 is mounted on the half-receiving mounting portion 51, the half-receiving support target portion 253 is fitted to a +Z side end of the third frame portion 101 (see FIG. 7). When the mounting portion lid 5 is closed, the half-receiving support target portion 253 is inserted into the lid-side half-receiving support portion 41 and is supported by the lid-side half-receiving support portion 41. The half-receiving support target portion 253 is pinched by the user when the half-receiving portion 79 is attached or detached. The half-receiving case 245 is provided with a half-receiving first tape guide portion 257 so as to chamfer the −Y side corner of the half-receiving support target portion 253. At the time of mounting the tape cartridge 401, the half-receiving first tape guide portion 257 guides the tape 413 fed from the tape cartridge 401 between the half-receiving portion 79 and the half-movable portion 81.

The blade-receiving attachment recessed portion 255 is provided on a −Y side surface of the half-receiving case 245. The blade-receiving member 247 is attached to the blade-receiving attachment recessed portion 255.

The blade-receiving member 247 is formed in a substantially rectangular plate shape that is elongated in the Z direction. A half-movable blade 269 (see FIG. 28) provided on the half-movable portion 81 comes into contact with or separates from the blade-receiving member 247.

The two spacers 249 are provided at both ends of the blade-receiving member 247 in the Z direction. When the half-movable blade 269 abuts on the spacer 249, the spacer 249 creates a gap between a half-movable blade tip 303 of the half-movable blade 269 and the blade-receiving member 247.

The two fixing members 251 are attached to both ends of the half-receiving case 245 in the Z direction by half-fixing screws 252, and fix the spacers 249 to the half-receiving case 245. The spacer 249 is fixed to the half-receiving case 245, so that the blade-receiving member 247 is sandwiched between the spacer 249 and the half-receiving case 245. Thereby, the blade-receiving member 247 is fixed to the half-receiving case 245. Note that, the fixing member 251 on the +Z side is provided with a half-receiving second tape guide portion 259 so as to chamfer the −Y side corner thereof. At the time of mounting the tape cartridge 401, the half-receiving second tape guide portion 259 guides the tape 413 fed from the tape cartridge 401 between the half-receiving portion 79 and the half-movable portion 81.

Half-Movable Portion

Figure 16:
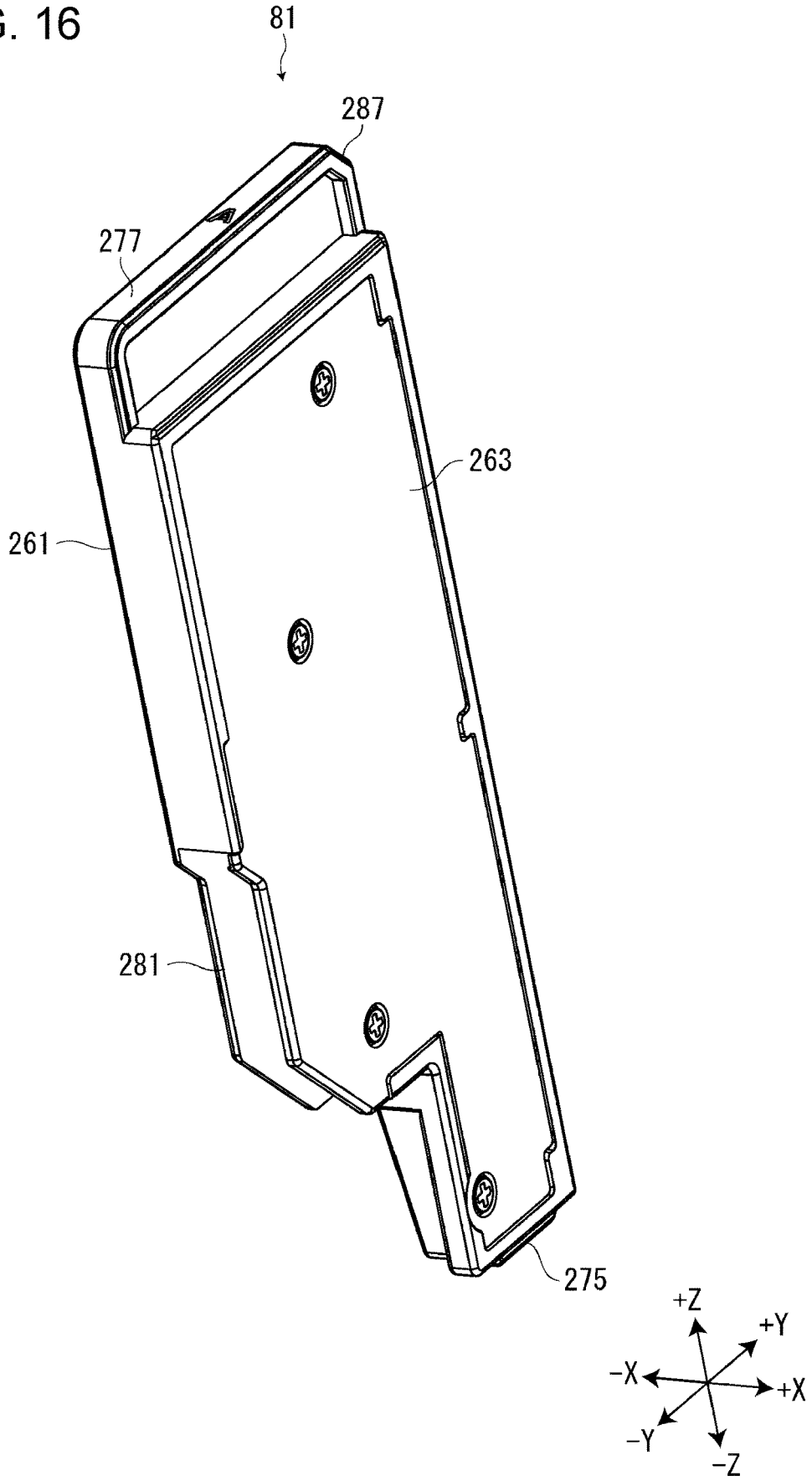
FIG. 16 is a perspective view of the half-movable portion.
Figure 17:
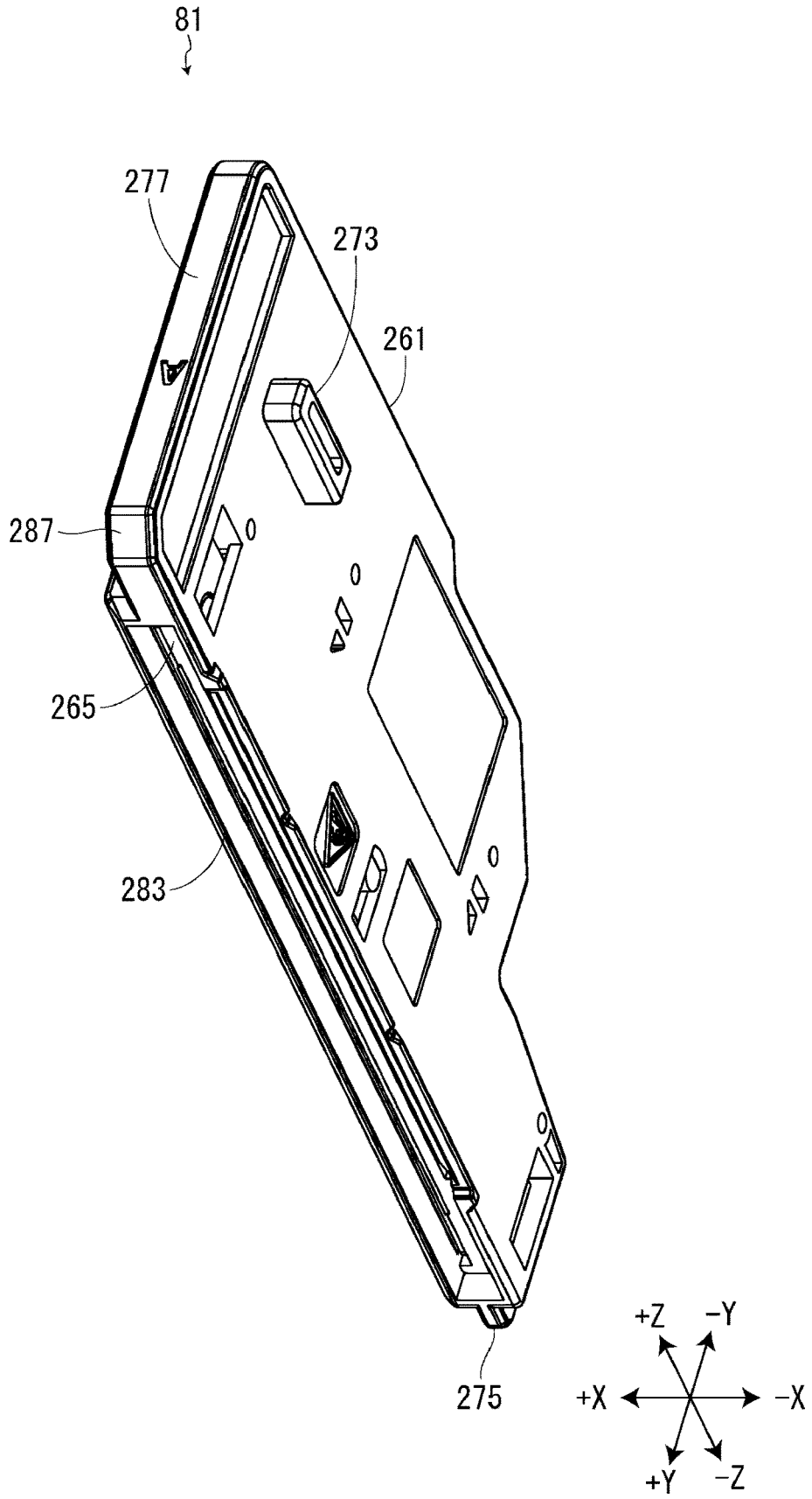
FIG. 17 is a perspective view of the half-movable portion viewed from an angle different from that in FIG. 16.
Figure 18:
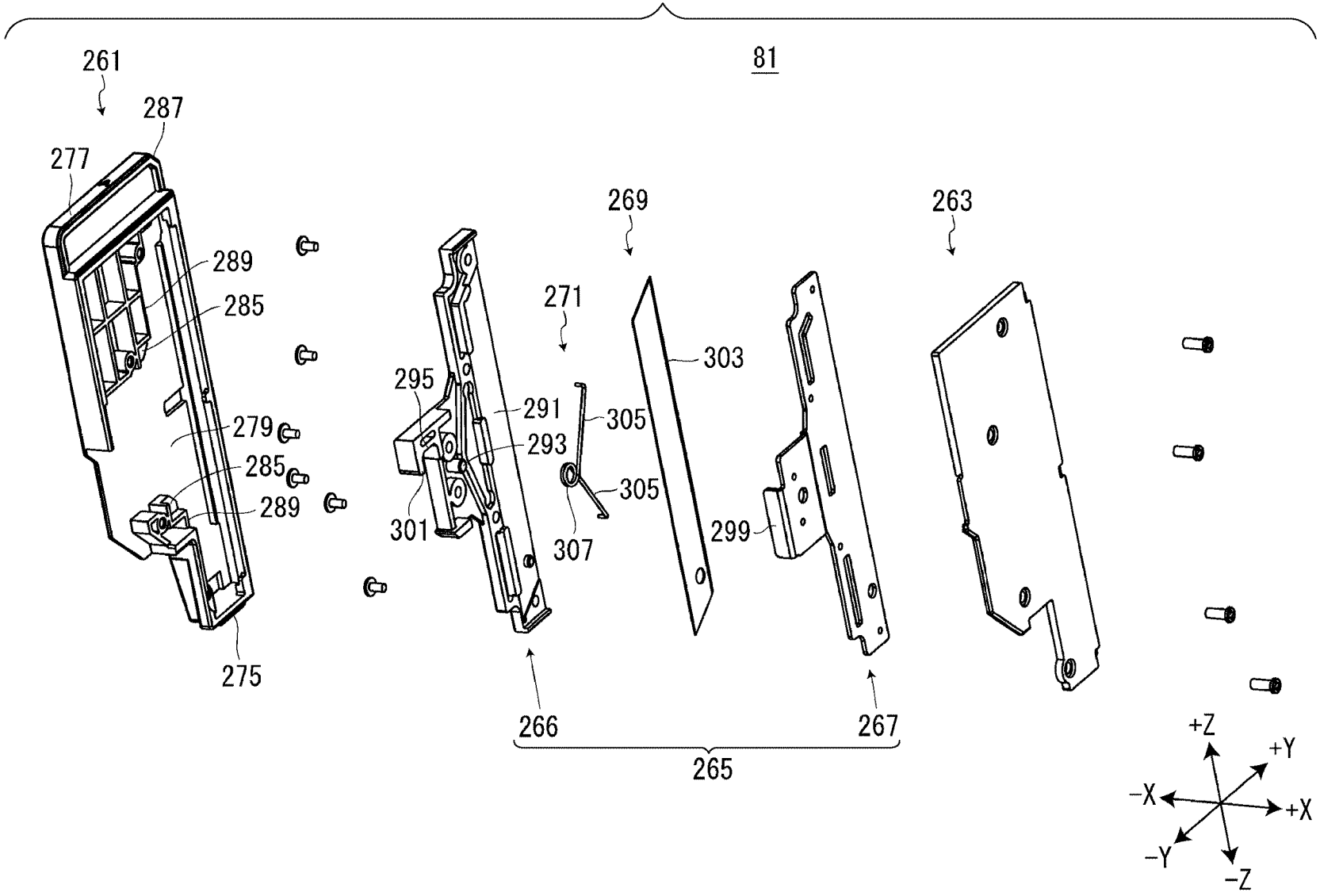
FIG. 18 is an exploded perspective view of the half-movable portion.

As illustrated in FIGS. 16 to 18, the half-movable portion 81 includes a half-movable case 261, a half-movable case cover 263, a half-movable holder 265, the half-movable blade 269, and a half return spring 271.

The half-movable case 261 accommodates the half-movable blade 269 so as to project and retract. The half-movable case 261 is provided with the half-movable guide engaging portion 273, the half-movable first support target portion 275, and the half-movable second support target portion 277. The half-movable case 261 is provided with a half-movable holder accommodating portion 279, a half drive opening 281, a half-blade entrance 283, and two spring hooking portions 285.

The half-movable guide engaging portion 273 is provided on a −X side surface of the half-movable case 261 and is formed in a projecting shape extending in the Z direction. The half-movable guide engaging portion 273 is engaged with the half-movable guide portion 63 provided in the half-movable mounting portion 53 to guide the attachment and detachment of the half-movable portion 81.

The half-movable first support target portion 275 is provided at a −Z side end of the half-movable case 261 and is formed in a projecting shape extending in the Y direction. When the half-movable portion 81 is mounted on the half-movable mounting portion 53, the half-movable first support target portion 275 is inserted into the mounting-side half-movable support portion 65, and is slidably supported by the mounting-side half-movable support portion 65 in the Y direction (see FIG. 7).

The half-movable second support target portion 277 is provided at a +Z side end of the half-movable case 261 and is formed in a projecting shape extending in the Y direction. When the mounting portion lid 5 is closed, the half-movable second support target portion 277 is inserted into the lid-side half-movable support portion 43 and is supported by the lid-side half-movable support portion 43 (see FIG. 7). The half-movable second support target portion 277 is pinched by the user when the half-movable portion 81 is attached or detached. The half-movable case 261 is provided with a half-movable tape guide portion 287 so as to chamfer the +Y side corner of the half-movable second support target portion 277. At the time of mounting the tape cartridge 401, the half-movable tape guide portion 287 guides the tape 413 fed The half-movable holder 265 is slidably accommodated in the half-movable holder accommodating portion 279 in the Y direction. The half-movable holder accommodating portion 279 is provided with two half abutment portions 289. When the half-movable holder 265 moves to the −Y side with respect to the half-movable case 261, the half-movable holder 265 abuts on the two half abutment portions 289 (see FIG. 31).

The half drive opening 281 is provided on a −Y side surface of the half-movable case 261. The half-pressing portion 95 of the cutter drive portion 69 is engaged with the half-movable holder 265 accommodated in the half-movable holder accommodating portion 279 through the half drive opening 281.

The half-blade entrance 283 is provided on a +Y side surface of the half-movable case 261 and is formed in a substantially rectangular shape that is long in the Z direction. The half-movable blade 269 accommodated in the half-movable case 261 projects from and retracts into the half-blade entrance 283.

Two arm portions 305 of the half return spring 271 are hooked on the two spring hooking portions 285.

The half-movable holder 265 is slidably accommodated in the half-movable case 261 in the Y direction. The half-movable holder 265 holds the half-movable blade 269. The half-movable holder 265 is reciprocated in the Y direction by being pressed and pulled by the half-pressing portion 95 of the cutter drive portion 69, and allows the held half-movable blade 269 to reciprocate in the Y direction.

The half-movable holder 265 includes a half-movable holder body 266 and a half-movable holder cover 267. The half-movable holder body 266 includes a half-movable blade attachment portion 291, a spring attachment projecting portion 293, and a half-pressing recessed portion 295.

The half-movable blade 269 is attached to the half-movable blade attachment portion 291. The +X side of the half-movable blade attachment portion 291 is open, and after the half-movable blade 269 is mounted, the open portion is closed by the half-movable holder cover 267. The spring attachment projecting portion 293 is inserted into a coil portion 307 of the half return spring 271.

The half-pressing recessed portion 295 is provided at a −Y side end of the half-movable holder 265, and is formed in a recessed shape with the +X side and the −Z side open similarly to the full-pressing recessed portion 211. The half-pressing recessed portion 295 extends in the Y direction, that is, the direction in which the half-movable portion 81 comes into contact with or separates from the half-receiving portion 79. The half second pressing portion 141 of the half-pressing portion 95 is inserted into the half-pressing recessed portion 295 (see FIG. 19). The half second pressing portion 141 moves in the half-pressing recessed portion 295 in the Y direction as the half lever 91 swings.

The half-movable holder 265 includes a half first pressing target portion 299 and a half second pressing target portion 301. The half first pressing target portion 299 is a portion that is pressed to the +Y side by the half first pressing portion 139, and is constituted by a −Y side end of the half-movable holder cover 267. The half second pressing target portion 301 is a portion that engages with the half second pressing portion 141 projecting to the +Z side and is pulled to the −Y side, and is constituted by a −Y side wall portion of the half-pressing recessed portion 295.

The half-movable blade 269 is held by the half-movable holder 265. When the half-movable holder 265 moves toward the half-receiving portion 79, the half-movable blade 269 projects from the half-blade entrance 283 and half-cuts the tape 413. The half-movable blade 269 is formed in a substantially rectangular plate shape. The half-movable blade tip 303 is provided on a +Y side edge of the half-movable blade 269. The half-movable blade tip 303 is formed in a substantially linear shape, and extends in the Z direction. That is, the blade length direction of the half-movable blade 269 is the Z direction.

The half return spring 271 is provided between the half-movable case 261 and the half-movable holder 265. As the half return spring 271, for example, a torsion coil spring can be used. The two arm portions 305 of the half return spring 271 are hooked on the two spring hooking portion 285 provided on the half-movable case 261, and the spring attachment projecting portion 293 provided on the half-movable holder 265 is inserted into the coil portion 307 of the half return spring 271. The half return spring 271 applies a force to the half-movable holder 265 toward −Y side, that is, the side opposite to the half-receiving portion 79.

Support of Half Cutter by Mounting Portion Cover

When the half-movable portion 81 approaches the half-receiving portion 79 and the half-receiving portion 79 is pressed by the half-movable portion 81, in a case in which the half-receiving portion 79 is displaced to the +Y side, a pressing force received by the half-receiving portion 79 from the half-movable portion 81 escapes. Therefore, a half-cut defect such as a case where the print tape 417 to be cut by the half cutter 73 is not cut may occur. For this reason, it is preferable that not only the half-receiving portion 79 is supported by the third frame portion 101 provided on the +Y side of the half-receiving portion 79, but also a +Z side end of the half-receiving portion 79 is supported by the +Z side end of the third frame portion 101.

However, at the time of mounting the tape cartridge 401, the +Z side, that is, one side of the half-movable blade 269 in the blade length direction is open between the half-receiving portion 79 and the half-movable portion 81 so that the tape 413 can be inserted between the half-receiving portion 79 and the half-movable portion 81. Therefore, it is difficult to provide a frame on the +Z side of the half-receiving portion 79 and the third frame portion 101 in order to support the +Z side end of the half-receiving portion 79 and the +Z side end of the third frame portion 101.

Figure 19:
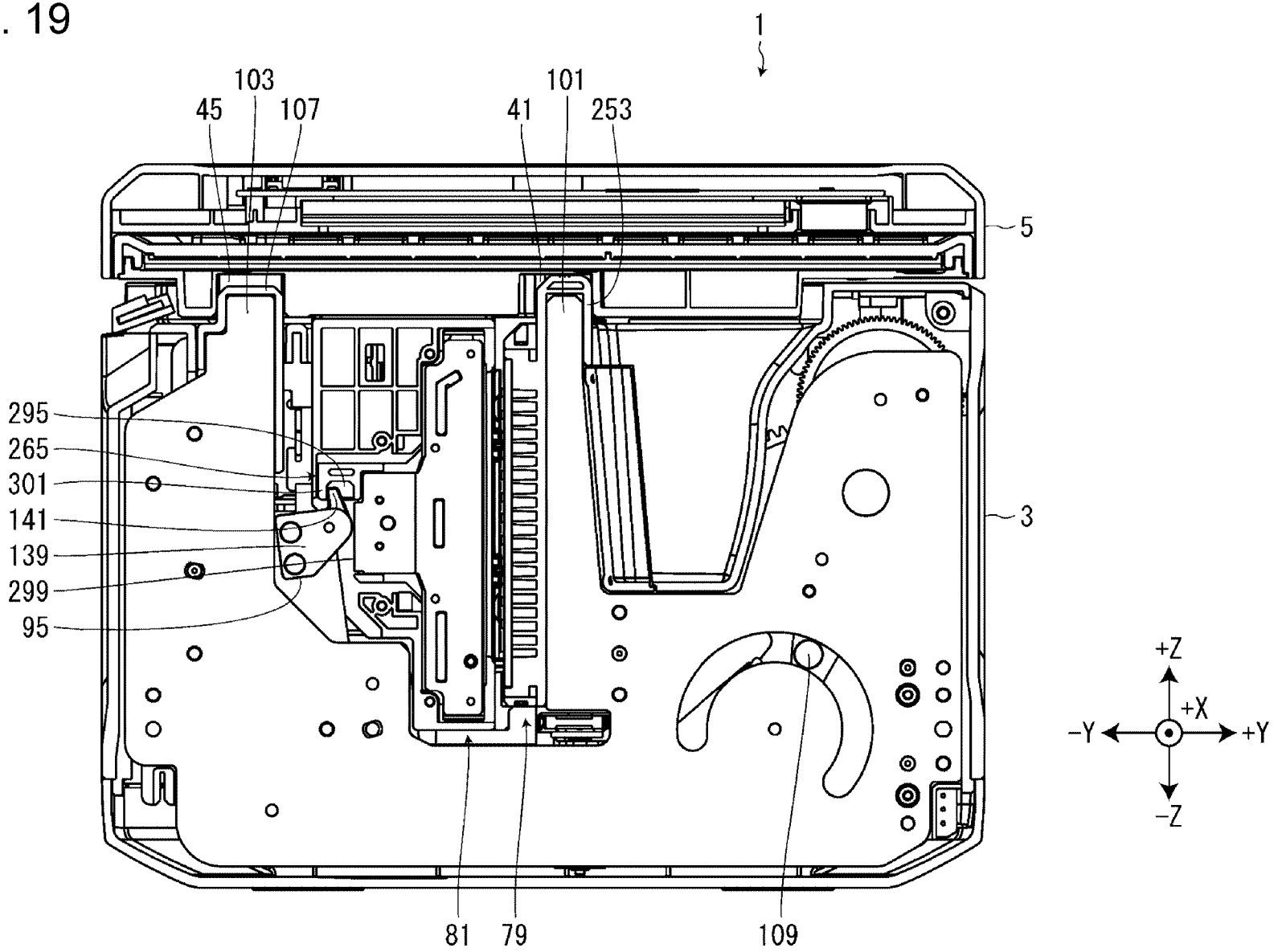
FIG. 19 is a sectional view of the tape printing apparatus viewed from the +X side, in a state where the half-movable portion is separated from the half-receiving portion.

In the present embodiment, the configuration is employed in which the +Z side end of the half-receiving portion 79 and the +Z side end of the third frame portion 101 are supported by the mounting portion lid 5 that opens and closes the +Z side of the half-receiving portion 79 and the third frame portion 101. That is, as illustrated in FIGS. 7 and 19, when the mounting portion lid 5 is closed, the +Z side end of the half-receiving portion 79, that is, the half-receiving support target portion 253 is inserted into the lid-side half-receiving support portion 41 provided on the mounting portion lid 5. The half-receiving support target portion 253 is fitted to the +Z side end of the third frame portion 101. Therefore, the +Z side end of the half-receiving portion 79 and the +Z side end of the third frame portion 101 are supported by the lid-side half-receiving support portion 41. Accordingly, when the half-receiving portion 79 is pressed by the half-movable portion 81, the displacement of the half-receiving portion 79 to the +Y side, that is, the side opposite to the half-movable portion 81 is suppressed, so that the escape of the pressing force received by the half-receiving portion 79 from the half-movable portion 81 is suppressed, and the tape 413 can be favorably half-cut. Note that, the lid-side half-receiving support portion 41 is not limited to the configuration in which it supports both the +Z side end of the half-receiving portion 79 and the +Z side end of the third frame portion 101, and may employ a configuration in which it supports at least one. The lid-side half-receiving support portion 41 is an example of a "lid-side receiving support portion".

When the half-receiving portion 79 is pressed by the half-movable portion 81, a reaction force from the half-receiving portion 79 against the pressing force from the half-movable portion 81 to the half-receiving portion 79 acts on the fourth frame portion 103 provided on the side opposite to the half-receiving portion 79 with respect to the half-movable portion 81. When the mounting portion lid 5 is closed, the +Z side end of the fourth frame portion 103 is inserted into the lid-side frame support portion 45 provided on the mounting portion lid 5, and is supported by the lid-side frame support portion 45. Therefore, the mounting portion lid 5 supports two portions where pulling forces act on each other, that is, the +Z side end of the half-receiving portion 79 and the +Z side end of the third frame portion 101 on which the pressing force from the half-movable portion 81 acts, and the +Z side end of the fourth frame portion 103 on which the reaction force from the half-receiving portion 79 acts. Accordingly, when the half-receiving portion 79 is pressed by the half-movable portion 81, the displacement of the half-receiving portion 79 to the side opposite to the half-movable portion 81 can be more effectively suppressed. The fourth frame portion 103 is an example of a "reaction force acting portion". The lid-side frame support portion 45 is an example of a "reaction force support portion".

The shape of the lid-side half-receiving support portion 41 is not particularly limited as long as it can support the half-receiving support target portion 253, and for example, may be configured to be formed in a projecting shape. The same applies to the lid-side frame support portion 45.

Suppression of Change of Cut Position by Mounting Portion Cover

Figure 20:
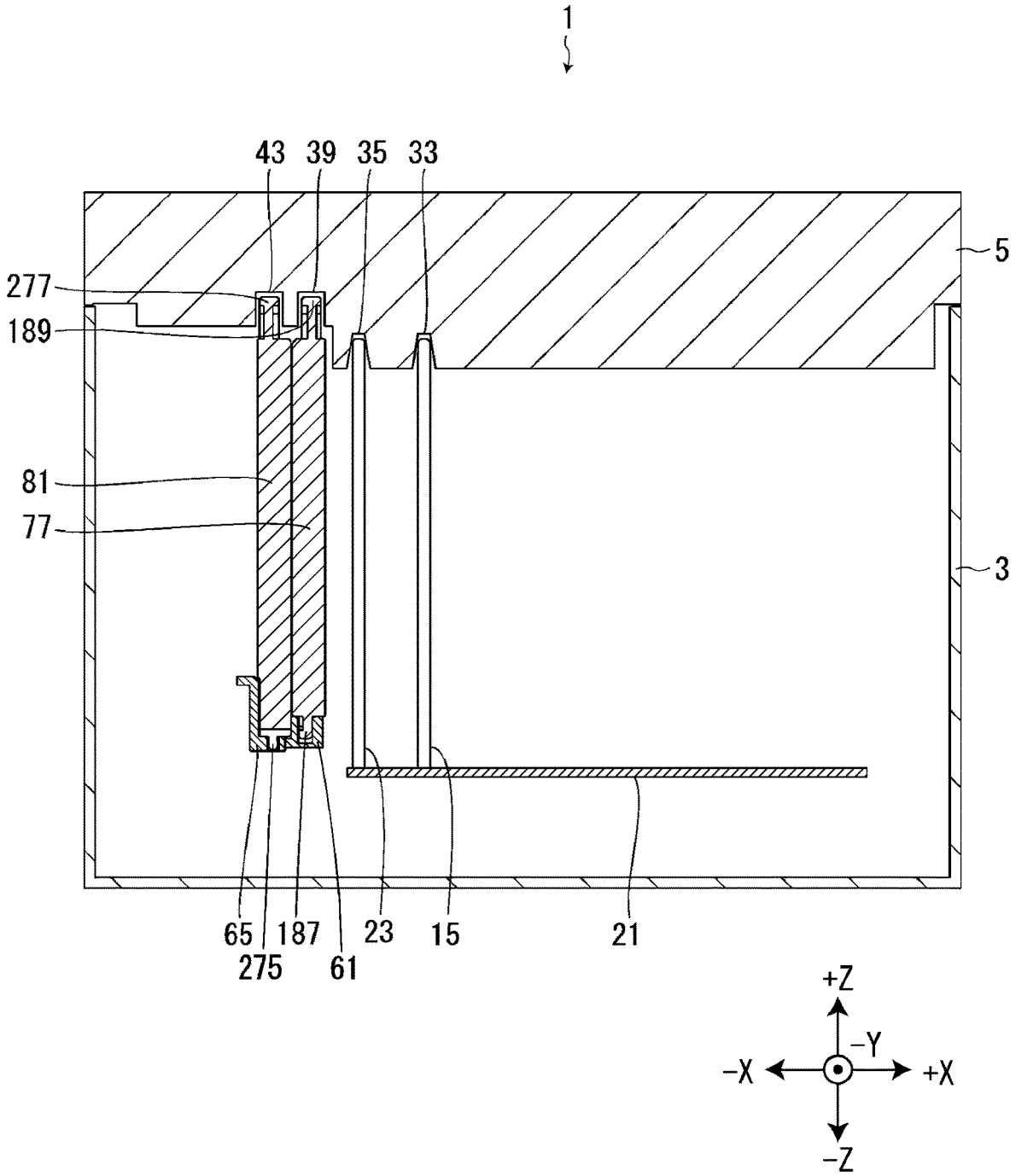
FIG. 20 is a sectional view of the tape printing apparatus schematically illustrating a state where a platen shaft, a head shaft, the full-movable portion, and the half-movable portion are supported by a mounting portion lid.

As illustrated in FIG. 20, the head shaft 15 and the platen shaft 23 are supported by the base frame 21 provided on the −Z side of the head shaft 15 and the platen shaft 23 in a cantilever manner. The full-movable portion 77 and the half-movable portion 81 are respectively supported by the mounting-side full-movable support portion 61 and the mounting-side half-movable support portion 65 provided on the −Z side of the full-movable portion 77 and the half-movable portion 81 in a cantilever manner. On the other hand, when the head shaft 15, the platen shaft 23, the full-movable portion 77, or the half-movable portion 81 is inclined in the X direction, that is, in the feed direction of the tape 413, a cut position of the tape 413 with respect to a print image changes. Therefore, it is preferable that not only the −Z side ends of the head shaft 15, the platen shaft 23, the full-movable portion 77, and the half-movable portion 81 but also the +Z side ends thereof are supported.

However, at the time of mounting the tape cartridge 401, the +Z side of the head shaft 15 and the platen shaft 23 is open so that the head shaft 15 and the platen shaft 23 can be inserted into the head insertion hole 423 and the platen roller 405, respectively. At the time of mounting the tape cartridge 401, the +Z side is open between the full-receiving portion 75 and the full-movable portion 77 and between the half-receiving portion 79 and the half-movable portion 81 so that the tape 413 can be inserted between the full-receiving portion 75 and the full-movable portion 77 and between the half-receiving portion 79 and the half-movable portion 81. Therefore, it is difficult to provide a frame on the +Z side of the head shaft 15, the platen shaft 23, the full-movable portion 77, and the half-movable portion 81 in order to support +Z side ends of the head shaft 15, the platen shaft 23, the full-movable portion 77, and the half-movable portion 81.

In the present embodiment, the configuration is employed in which the +Z side ends of the head shaft 15, the platen shaft 23, the full-movable portion 77, and the half-movable portion 81 are supported by the mounting portion lid 5 that opens and closes the +Z side of the head shaft 15, the platen shaft 23, the full-movable portion 77, and the half-movable portion 81. That is, when the mounting portion lid 5 is closed, the +Z side ends of the head shaft 15, the platen shaft 23, the full-movable portion 77, and the half-movable portion 81 are respectively inserted into the lid-side head shaft support portion 33, the lid-side platen shaft support portion 35, the lid-side full-movable support portion 39, and the lid-side half-movable support portion 43 provided on the mounting portion lid 5. Therefore, the +Z side ends of the head shaft 15, the platen shaft 23, the full-movable portion 77, and the half-movable portion 81 are respectively supported by the lid-side head shaft support portion 33, the lid-side platen shaft support portion 35, the lid-side full-movable support portion 39, and the lid-side half-movable support portion 43.

Thereby, the inclination of the head shaft 15, the platen shaft 23, the full-movable portion 77, and the half-movable portion 81 in the X direction is suppressed. For this reason, the change of the distance between the platen roller 405 and the print head 17, and the full-movable portion 77, that is, the distance between the print position and the full cut position in the tape printing apparatus 1 is suppressed. Similarly, the change of the distance between the platen roller 405 and the print head 17, and the half-movable portion 81, that is, the distance between the print position and the half cut position in the tape printing apparatus 1 is suppressed. Therefore, it is possible to suppress a change in the cut position of the tape 413 with respect to the print image.

The shapes of the +Z side end of the head shaft 15 and the lid-side head shaft support portion 33 are not particularly limited as long as the lid-side head shaft support portion 33 can support the +Z side end of the head shaft 15, for example, the +Z side end of the head shaft 15 may have a recessed shape and the lid-side head shaft support portion 33 may have a projecting shape. The same applies to the shapes of the +Z side end of the platen shaft 23 and the lid-side platen shaft support portion 35, the shapes of the +Z side end of the full-movable portion 77 and the lid-side full-movable support portion 39, and the shapes of the +Z side end of the half-movable portion 81 and the lid-side half-movable support portion 43.

The mounting portion lid 5 is not limited to the configuration in which all the lid-side platen shaft support portion 35, the lid-side head shaft support portion 33, the lid-side full-movable support portion 39, and the lid-side half-movable support portion 43 are provided, and may have a configuration in which at least one is provided.

Positioning of Full-Receiving Portion with Respect to Full-Movable Portion

When the full-receiving blade 151 and the full-movable blade 175 overlap and rub against each other in the X direction, the full cutter 71 fully cuts the tape 413, that is, shears the tape 413. Therefore, when the full-receiving blade 151 and the full-movable blade 175 overlap in the X direction, in a case in which the full-receiving blade 151 escapes to the +X side, that is, to the side opposite to the full-movable blade 175, the full-receiving blade 151 and the full-movable blade 175 cannot rub against each other, and the tape 413 may not be appropriately fully cut.

Figure 21:
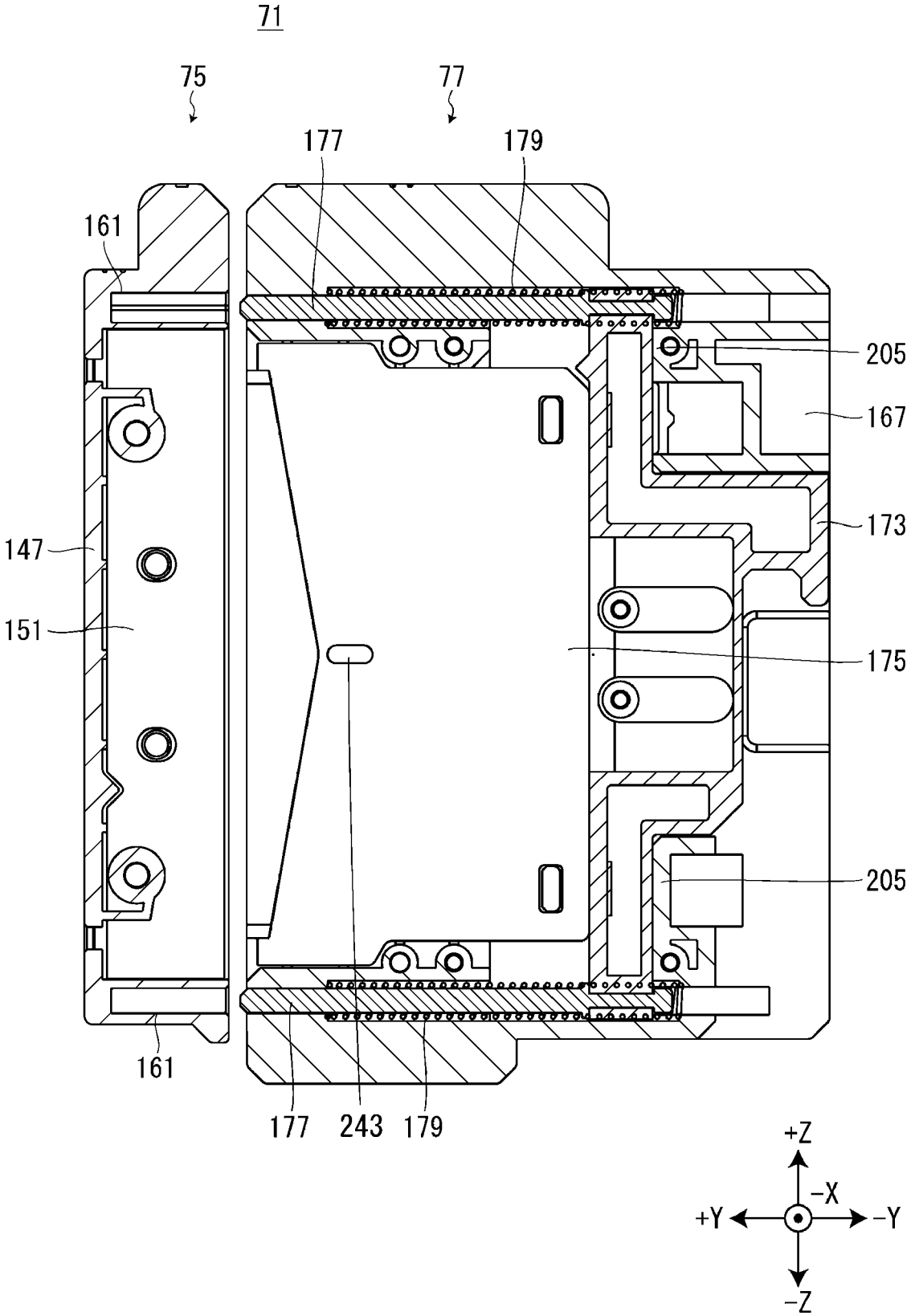
FIG. 21 is a sectional view illustrating an initial state of the full cutter.
Figure 22:
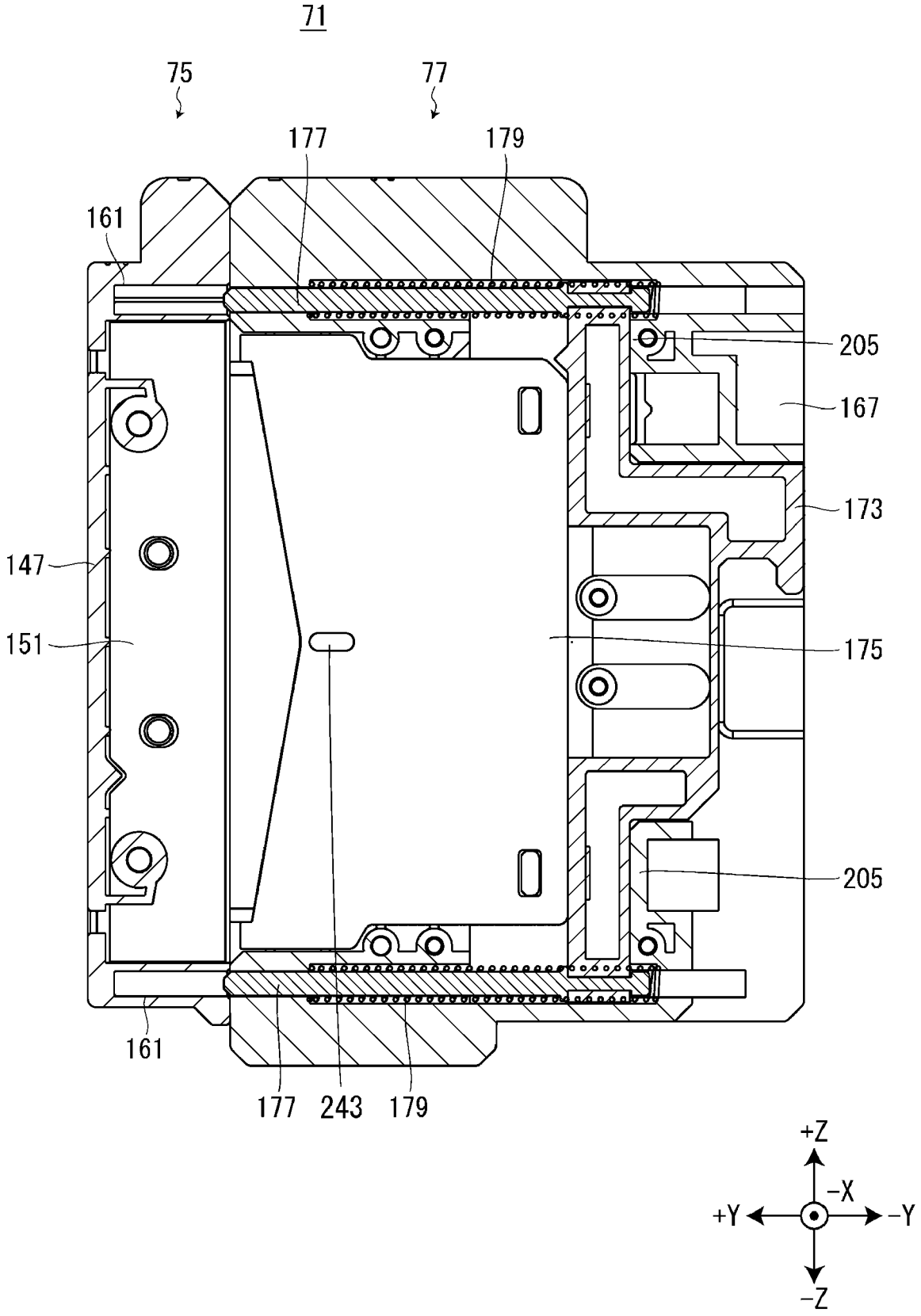
FIG. 22 is a sectional view illustrating a state following the state in FIG. 21 of the full cutter.

In the present embodiment, the configuration is employed in which the full-receiving portion 75 is positioned in the X direction with respect to the full-movable portion 77. FIG. 21 illustrates an initial state of the full cutter 71, that is, a state where the full-movable portion 77 is separated from the full-receiving portion 75. In this state, when the full-movable holder 173 is pressed toward the full-receiving portion 75 by the full-pressing portion 93, as illustrated in FIG. 22, the full-movable case 167 is pressed toward the full-receiving portion 75 through the full return spring 179. Therefore, the full-movable portion 77 moves integrally toward the full-receiving portion 75, and the full-movable case 167 abuts on the full-receiving case 147 through the tape 413 (not illustrated in FIGS. 21 to 27).

Figure 23:
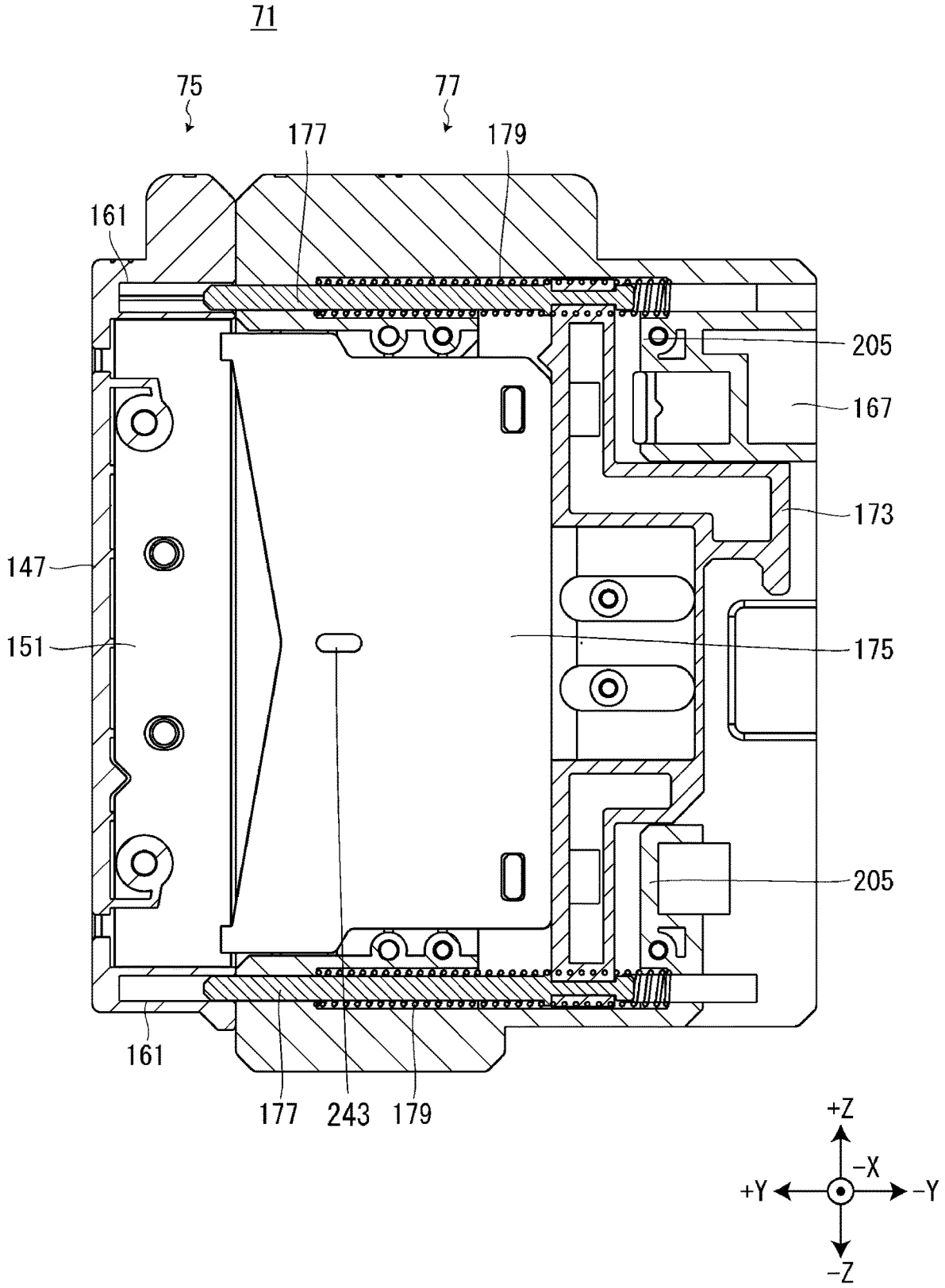
FIG. 23 is a sectional view illustrating a state following the state in FIG. 22 of the full cutter.
Figure 24:
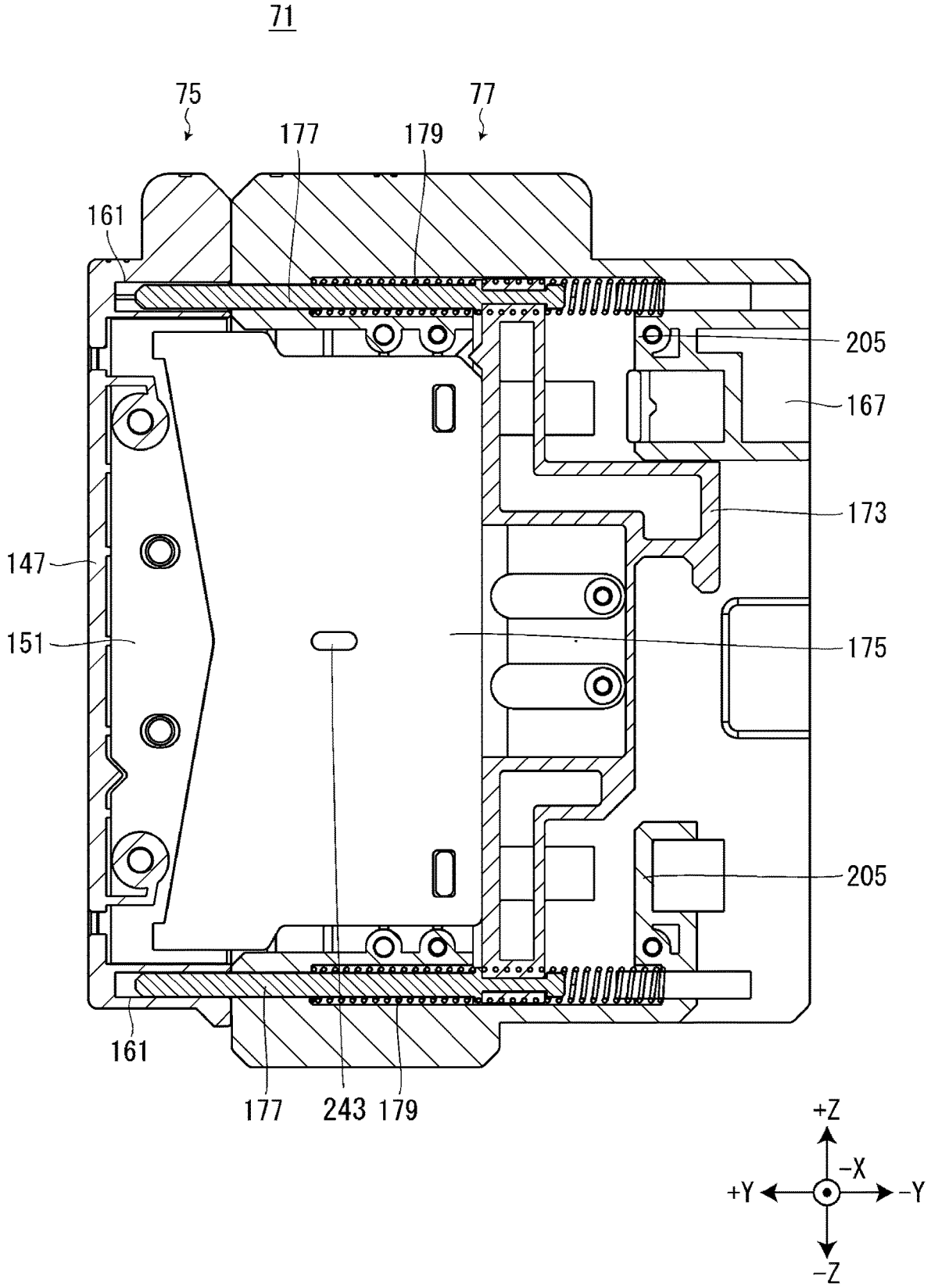
FIG. 24 is a sectional view illustrating a state following the state in FIG. 23 of the full cutter.

After the full-movable case 167 abuts on the full-receiving case 147, as illustrated in FIG. 23, the full-movable blade 175 and the two positioning pins 177 held by the full-movable holder 173 move toward the full-receiving portion 75 while compressing the full return springs 179 with respect to the full-movable case 167. Thereby, the full-movable blade 175 retracts into the full-receiving case 147 through the blade entrance 159, and the two positioning pins 177 are inserted into the two positioning holes 161. Then, as illustrated in FIG. 24, when the full-receiving blade 151 and the full-movable blade 175 overlap and rub against each other in the X direction, the tape 413 is sheared from both ends in the width direction of the tape 413 toward the center of thereof.

Figure 25:
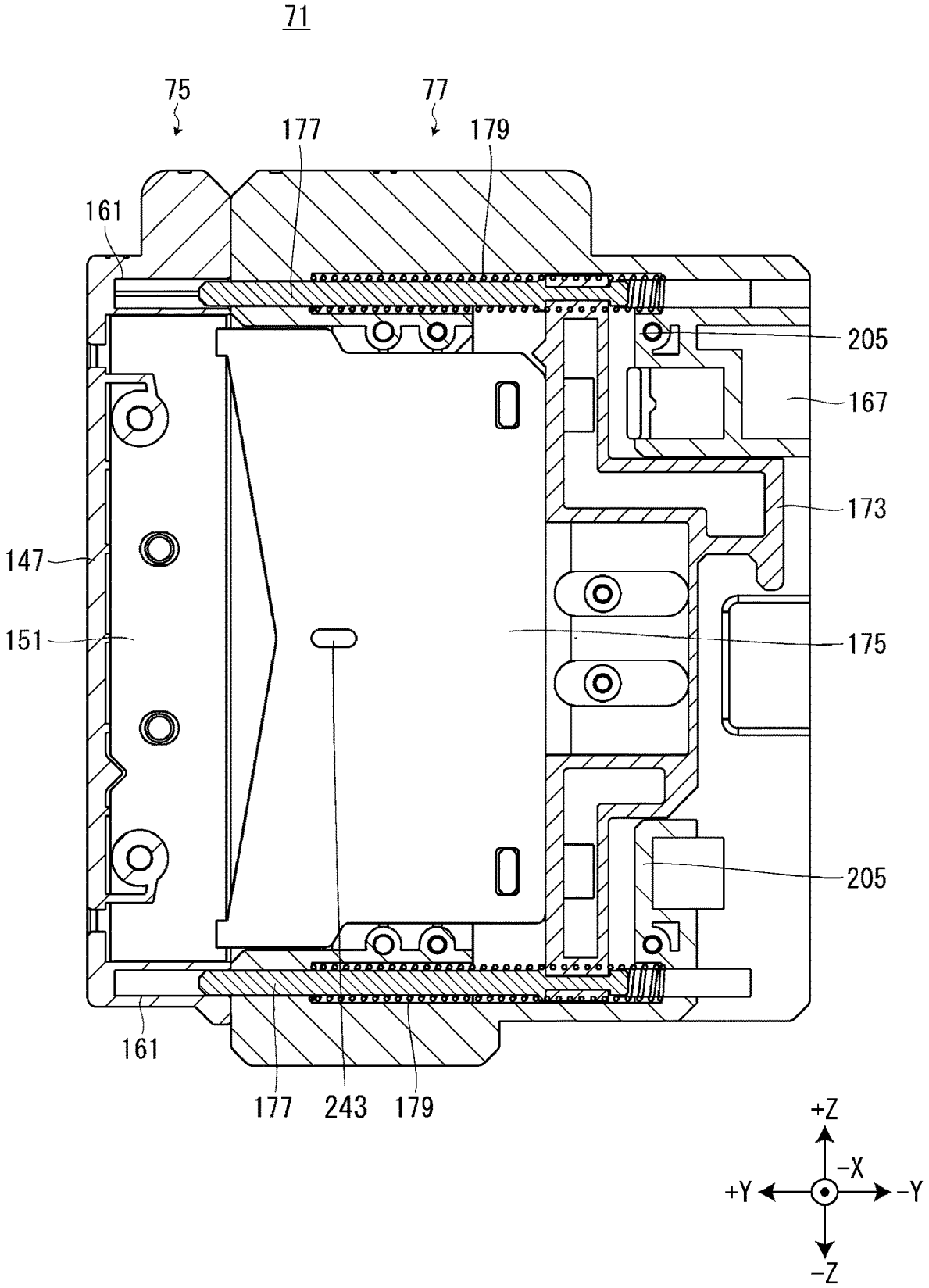
FIG. 25 is a sectional view illustrating a state following the state in FIG. 24 of the full cutter.
Figure 26:
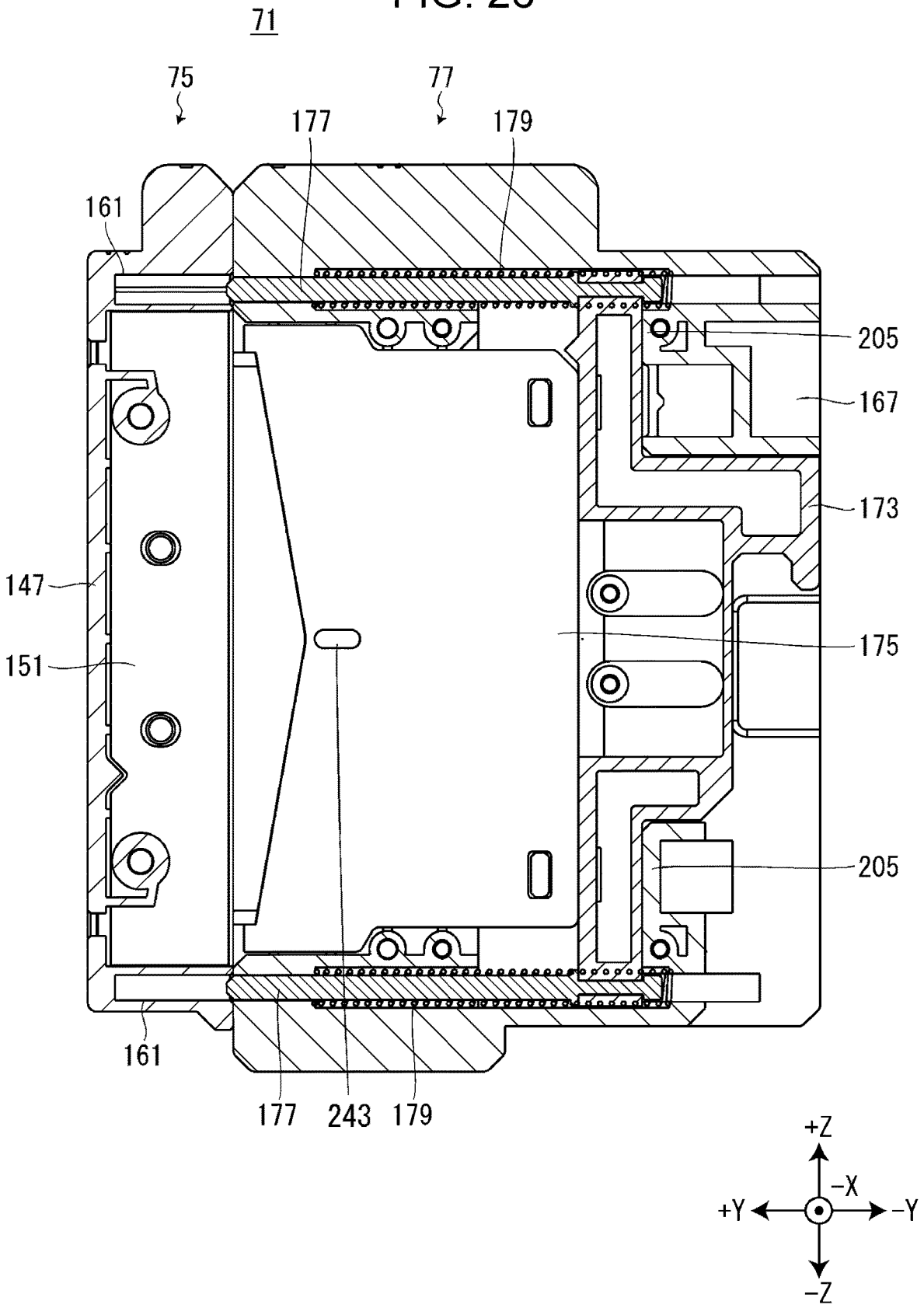
FIG. 26 is a sectional view illustrating a state following the state in FIG. 25 of the full cutter.

Subsequently, when the full-pressing portion 93 moves toward the side opposite to the full-receiving portion 75, the full-movable holder 173 is pressed toward the side opposite to the full-receiving portion 75 by the full return spring 179. Accordingly, as illustrated in FIG. 25, the full-movable blade 175 and the two positioning pins 177 held by the full-movable holder 173 move toward the side opposite to the full-receiving portion 75 and retract into the full-movable case 167. After the full-movable holder 173 abuts on the full abutment portion 205 as illustrated in FIG. 26, the full-movable portion 77 moves integrally toward the side opposite to the full-receiving portion 75, and the full-movable case 167 separates from the full-receiving case 147 and returns to the initial state, as illustrated in FIG. 27.

Figure 27:
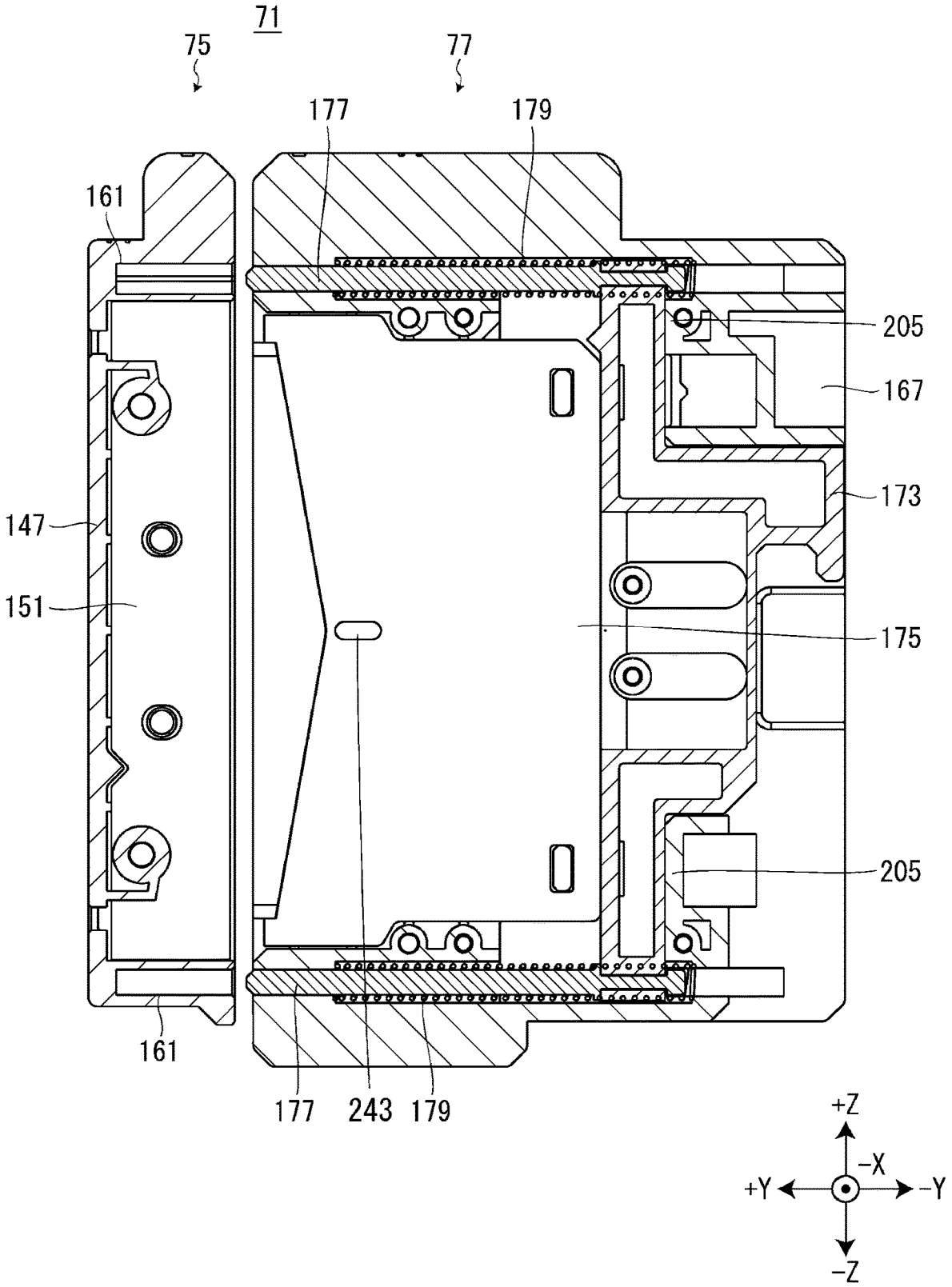
FIG. 27 is a sectional view illustrating a state following the state in FIG. 26 of the full cutter.

The retracting of the positioning pin 177 into the full-movable case 167 means including not only the state where the entire positioning pin 177 is accommodated in the full-movable case 167 but also the state where a +Y side end of the positioning pin 177 projects from the full-movable case 167, as illustrated in FIG. 27. In FIGS. 21 to 27, the full return spring 179 is illustrated with the same length without expansion and contraction, but actually, the full return spring 179 expands and contracts in accordance with the movement of the positioning pin 177 with respect to the full-movable case 167.

As described above, when the two positioning pins 177 are inserted into the two positioning holes 161, the full-receiving case 147 is positioned in the X direction with respect to the full-movable case 167, as a result, the full-receiving blade 151 is positioned in the X direction with respect to the full-movable blade 175. Therefore, when the full-receiving blade 151 and the full-movable blade 175 overlap in the X direction, the escape of the full-receiving blade 151 to the +X side, that is, the side opposite to the full-movable blade 175 is suppressed. Accordingly, the full-receiving blade 151 and the full-movable blade 175 can appropriately rub against each other, and the tape 413 can be favorably fully cut.

Since the configuration is employed in which the two positioning pins 177 are inserted into the two positioning holes 161, the full-receiving blade 151 can be favorably positioned with respect to the full-movable blade 175 with a simple configuration. The number of the positioning pins 177 may be one or three or more. However, in the present embodiment, since the two positioning pins 177 are disposed so as to sandwich the full-movable blade 175 in the Z direction, the full-receiving blade 151 can be positioned with respect to the full-movable blade 175 with a good balance. The same applies to the number of positioning holes 161. The shape of the positioning pin 177 is not limited to a substantially columnar shape, and may be, for example, a substantially prismatic shape. Further, the method for positioning the full-receiving blade 151 with respect to the full-movable blade 175 is not limited to the configuration in which the positioning pin 177 is inserted into the positioning hole 161, for example, a configuration in which the positioning pin 177 is engaged with a +X side surface of the full-receiving case 147 may be employed.

Since the positioning pin 177 retracts into the full-movable case 167 when the full-movable portion 77 moves toward the side opposite to the full-receiving portion 75, when the tape 413 is inserted between the full-receiving portion 75 and the full-movable portion 77, it is possible to suppress the positioning pin 177 from hindering.

In the state where the tape 413 is sandwiched between the full-receiving case 147 and the full-movable case 167, the full-movable blade 175 projects from and retracts into the full-movable case 167. Therefore, even when a cut end of the tape 413 is attached to the full-movable blade 175 by the adhesive of the tape 413, the full-movable blade 175 can be separated from the attached tape 413. Thereby, at the time of feeding the tape after the full cut, it is possible to suppress the occurrence of troubles in feeding the tape 413.

Figure 28:
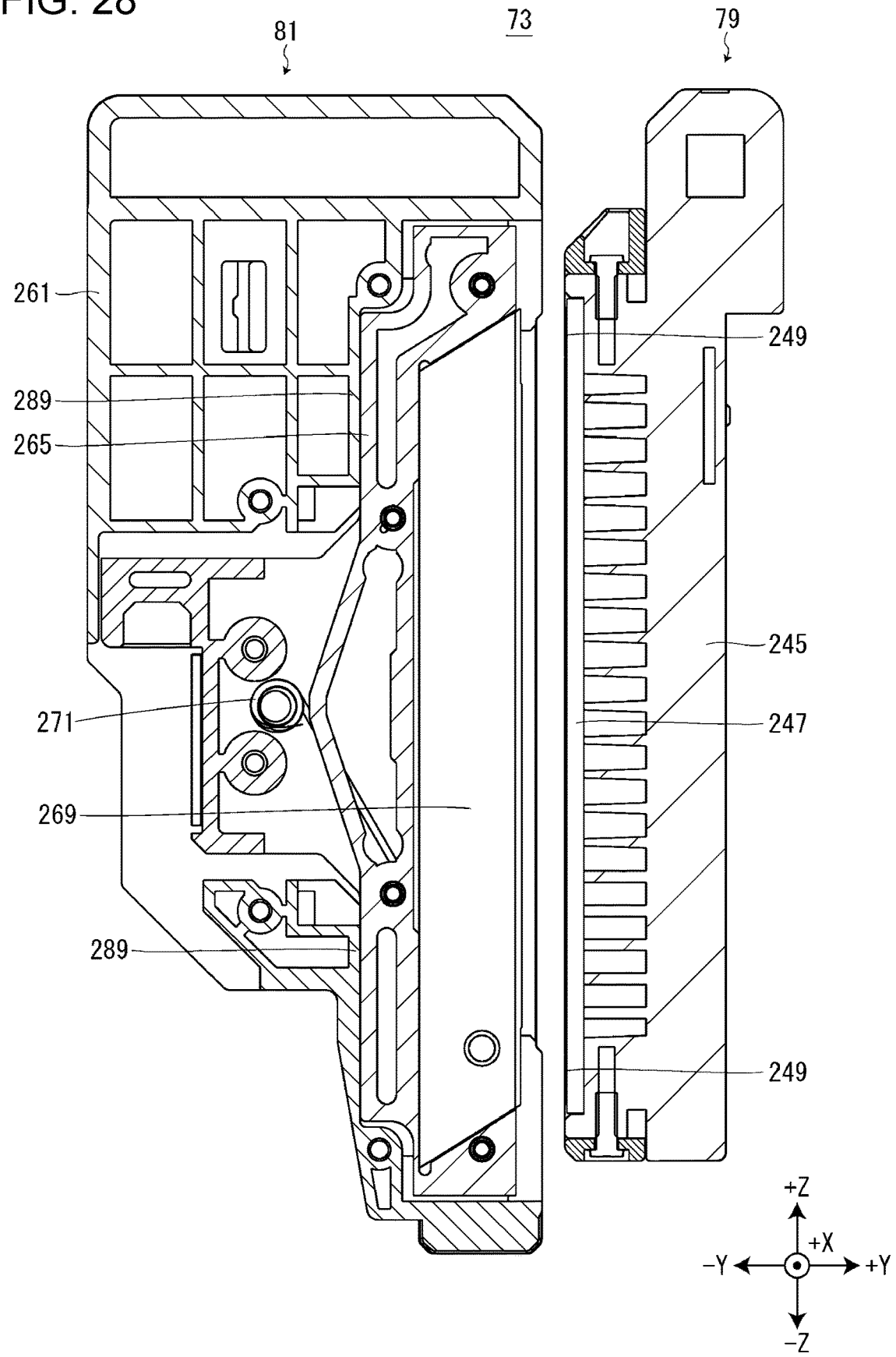
FIG. 28 is a sectional view illustrating an initial state of the half cutter.
Figure 29:
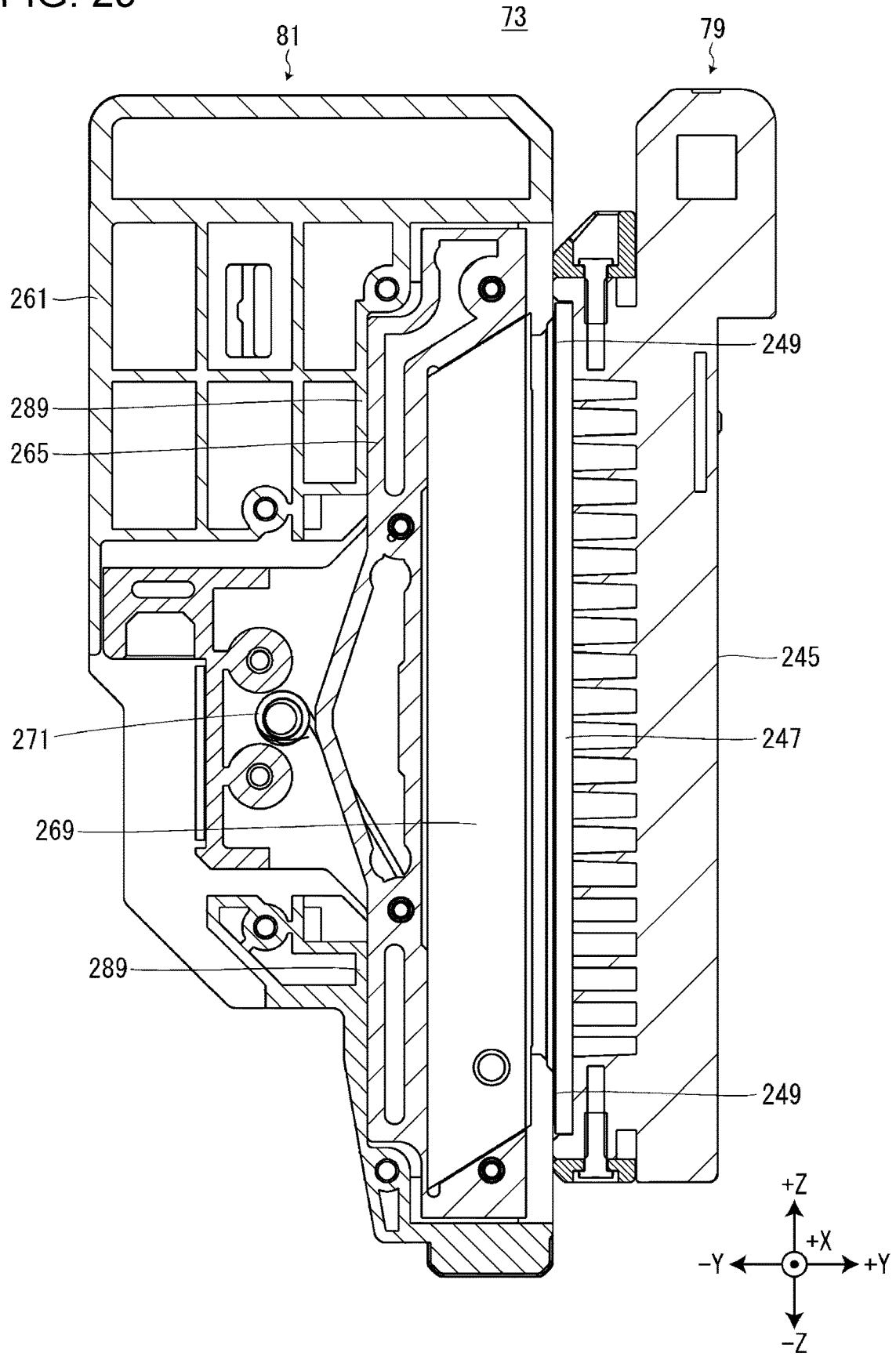
FIG. 29 is a sectional view illustrating a state following the state in FIG. 28 of the half cutter.

Also in the half cutter 73, similarly to the full cutter 71, the half-movable blade 269 projects from and retracts into the half-movable case 261 in the state where the tape 413 is sandwiched between the half-receiving case 245 and the half-movable case 261. FIG. 28 illustrates an initial state of the half cutter 73, that is, a state where the half-movable portion 81 is separated from the half-receiving portion 79. In this state, when the pressure is applied toward the half-movable holder 265 by the half-pressing portion 95, as illustrated in FIG. 29, the half-movable case 261 is pressed toward the half-receiving portion 79 through the half return spring 271. Therefore, the half-movable portion 81 moves integrally toward the half-receiving portion 79, and the half-movable case 261 abuts on the half-receiving case 245 through the tape 413 (not illustrated in FIGS. 28 to 32).

Figure 30:
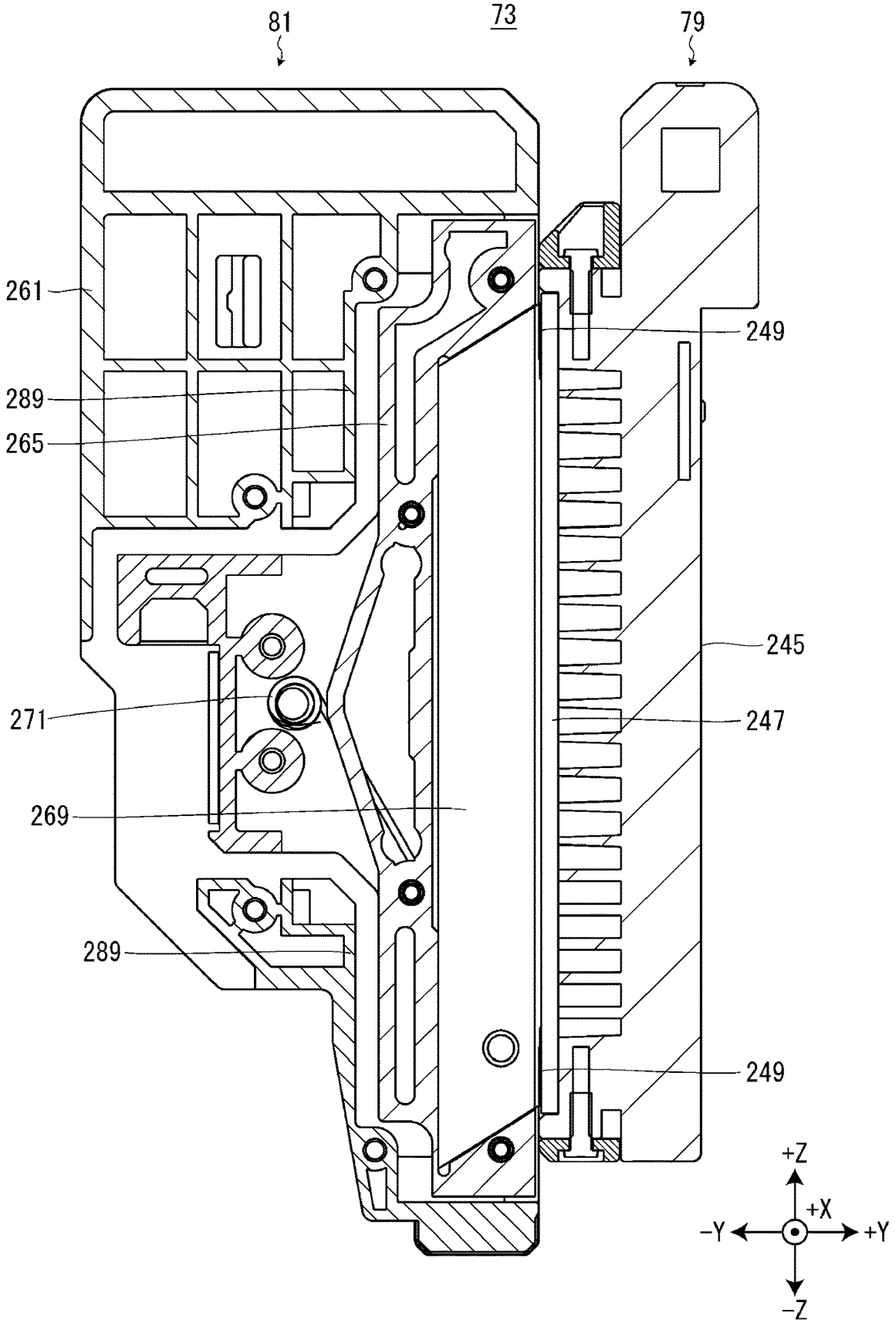
FIG. 30 is a sectional view illustrating a state following the state in FIG. 29 of the half cutter.

After the half-movable case 261 abuts on the half-receiving case 245, as illustrated in FIG. 30, the half-movable blade 269 held by the half-movable holder 265 moves toward the half-receiving portion 79 against the half return spring 271 with respect to the half-movable case 261. When the half-movable blade 269 abuts on the spacer 249, the tape 413 is half-cut.

Figure 31:
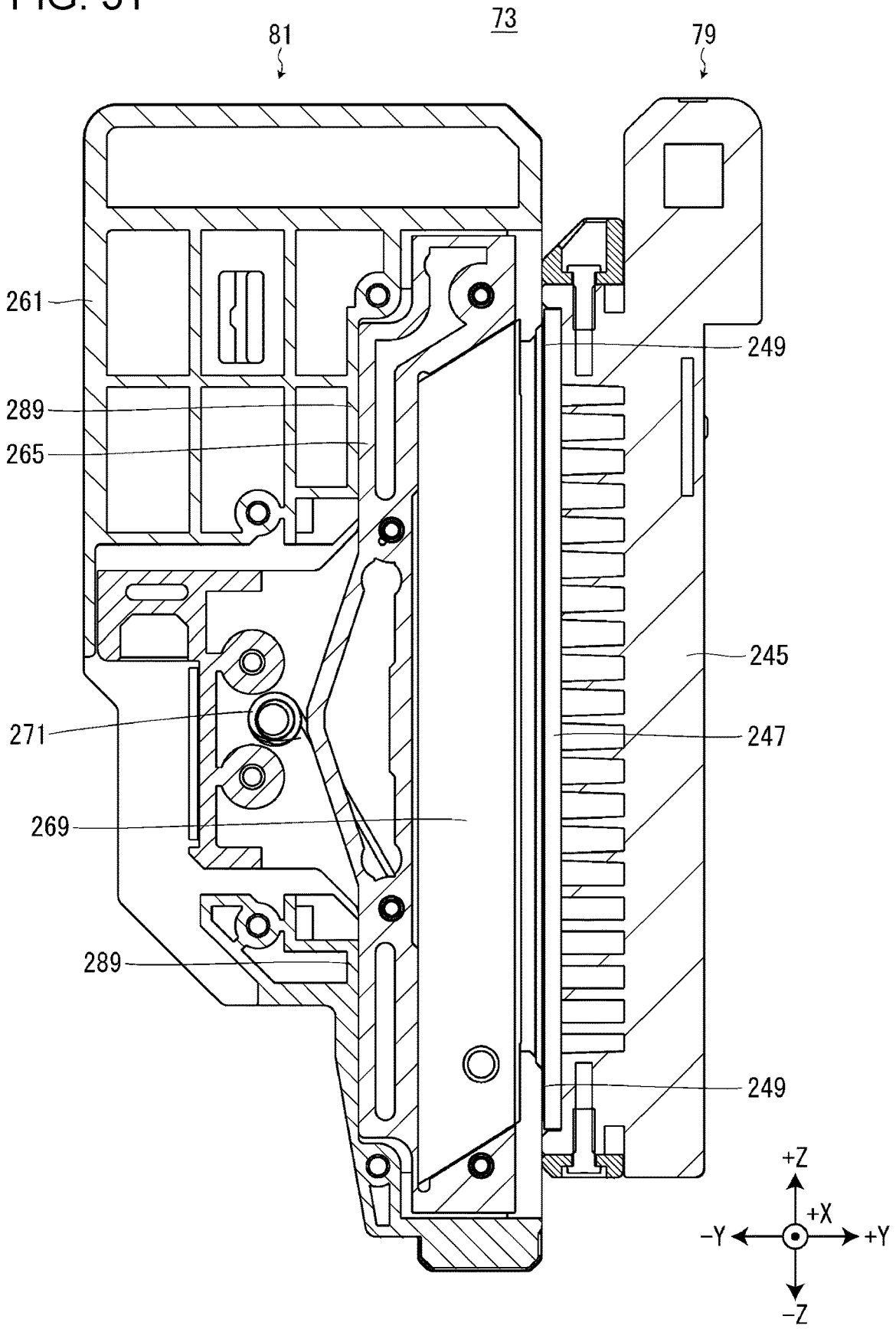
FIG. 31 is a sectional view illustrating a state following the state in FIG. 30 of the half cutter.
Figure 32:
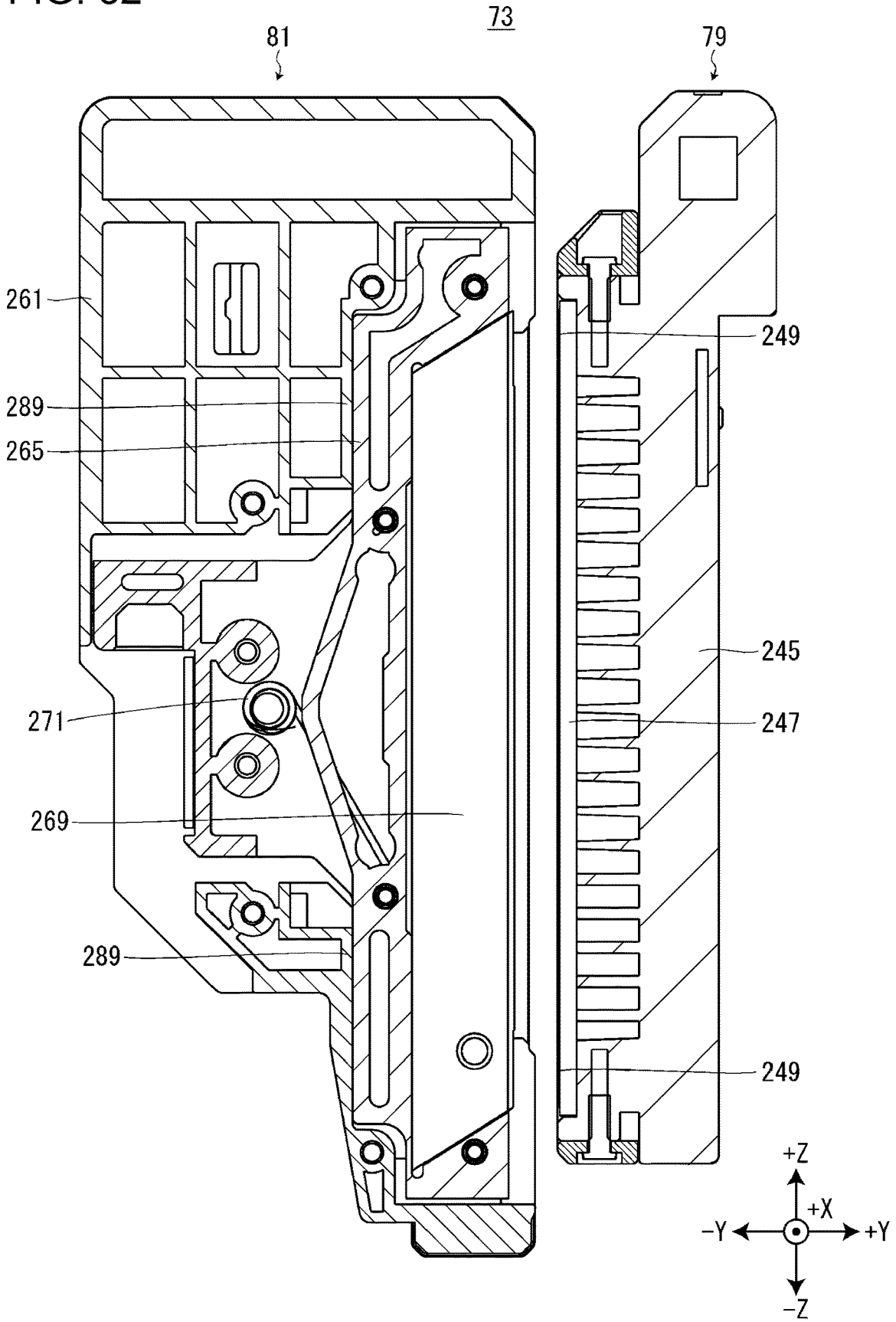
FIG. 32 is a sectional view illustrating a state following the state in FIG. 31 of the half cutter.

Subsequently, when the half-pressing portion 95 moves toward the side opposite to the half-receiving portion 79, the half-movable holder 265 is pressed toward the side opposite to the half-receiving portion 79 by the half return spring 271. Accordingly, as illustrated in FIG. 31, the half-movable blade 269 held by the half-movable holder 265 moves toward the side opposite to the half-receiving portion 79 and retracts into the half-movable case 261. After the half-movable holder 265 abuts on the half abutment portion 289, the half-movable portion 81 moves integrally toward the half-receiving portion 79, and the half-movable case 261 separates from the half-receiving case 245 and returns to the initial state, as illustrated in FIG. 32.

As described above, when the half-movable blade 269 projects from and retracts into the half-movable case 261 in the state where the tape 413 is sandwiched between the half-receiving case 245 and the half-movable case 261, even when the cut end of the tape 413 is attached to the half-movable blade 269 by the adhesive of the tape 413, the half-movable blade 269 can be separated from the attached tape 413. Thereby, at the time of feeding the tape after the half cut, it is possible to suppress the occurrence of troubles in feeding the tape 413.

Full-Pressing Portion and Half-Pressing Portion

Figure 33:
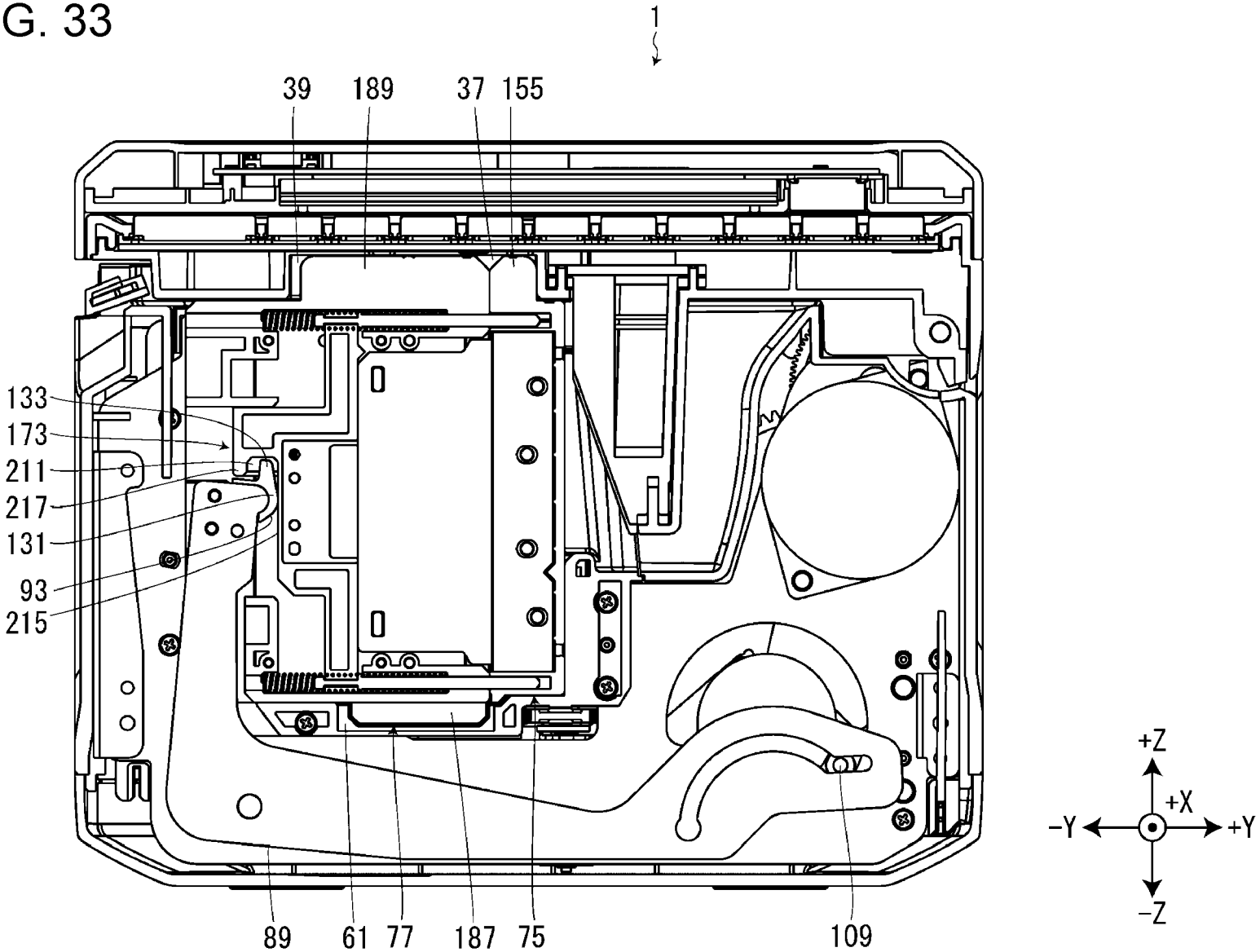
FIG. 33 is a sectional view of the tape printing apparatus viewed from the +X side, in a state where the full-movable portion approaches the full-receiving portion.
Figure 34:
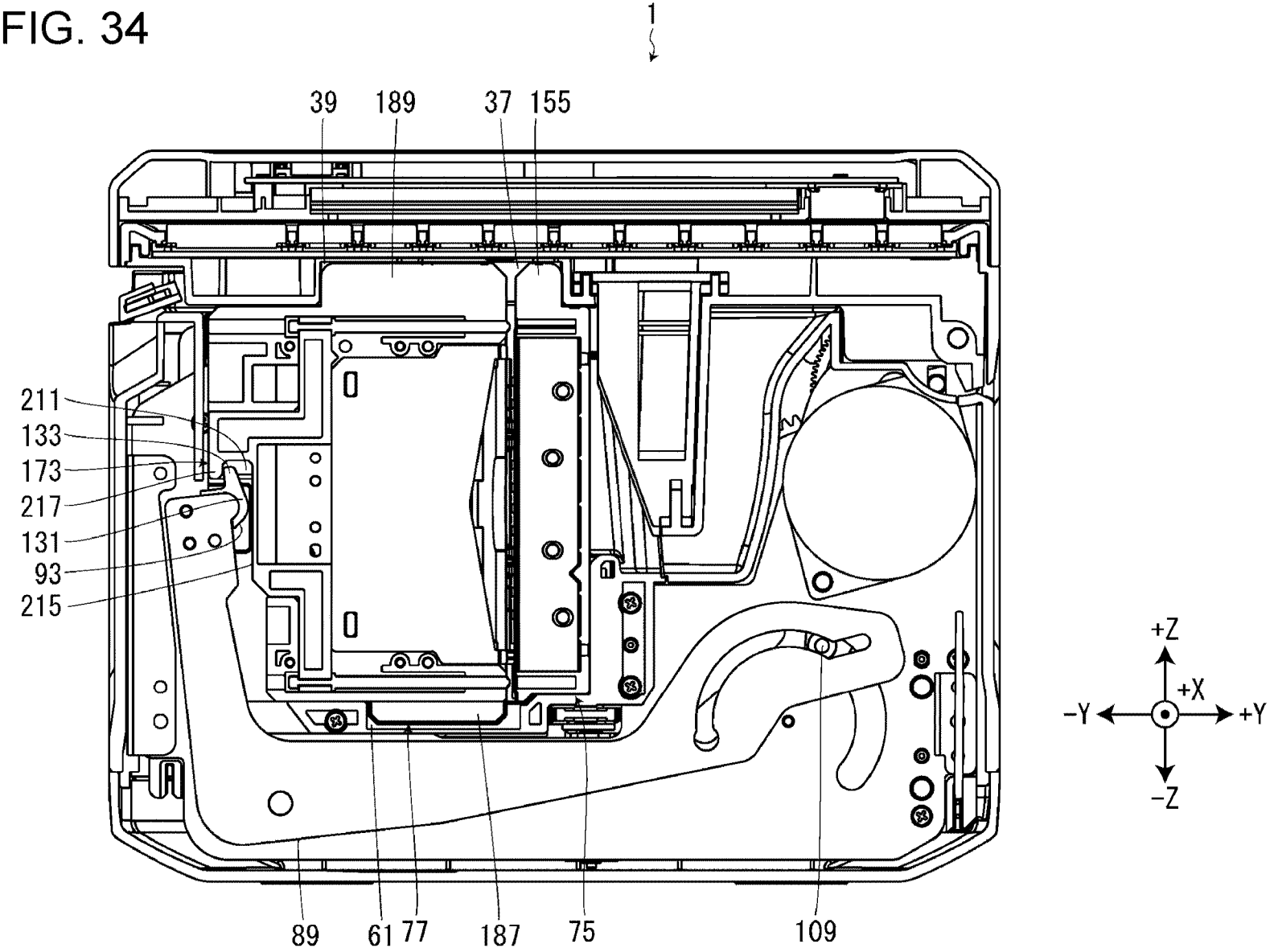
FIG. 34 is a sectional view of the tape printing apparatus viewed from the +X side, in a state where the full-movable portion is separated from the full-receiving portion.

As illustrated in FIG. 33, the full first pressing portion 131 moves the full-movable holder 173 toward the full-receiving portion 75 by pressing the full first pressing target portion 215 toward the full-receiving portion 75. As illustrated in FIG. 34, the full second pressing portion 133 moves the full-movable holder 173 toward the side opposite to the full-receiving portion 75 by pulling the full second pressing target portion 217 toward the side opposite to the full-receiving portion 75.

As illustrated in FIG. 7, the half first pressing portion 139 moves the half-movable portion 81 toward the half-receiving portion 79 by pressing the half first pressing target portion 299 toward the half-receiving portion 79. As illustrated in FIG. 19, the half second pressing portion 141 moves the half-movable portion 81 toward the side opposite to the half-receiving portion 79 by pulling the half second pressing target portion 301 toward the side opposite to the half-receiving portion 79.

Here, unlike the present embodiment, when the full first pressing portion 131 and the full second pressing portion 133 are configured to project to the +X side or the −X side from the full second lever portion 117 to which the full first pressing portion 131 and the full second pressing portion 133 are fixed, the full first pressing portion 131 and the full second pressing portion 133 correspondingly increase in size in the X direction, that is, the feed direction of the tape 413. The half first pressing portion 139 and the half second pressing portion 141 have similar problems.

Therefore, in the present embodiment, as illustrated in FIG. 6, the configuration is employed in which the full first pressing portion 131 and the full second pressing portion 133 are provided at a position overlapping with the full second lever portion 117 in the X direction, that is, the feed direction of the tape 413. Thereby, the enlargement of the full first pressing portion 131 and the full second pressing portion 133 in the feed direction of the tape 413 can be suppressed.

In the present embodiment, the configuration is employed in which the half first pressing portion 139 and the half second pressing portion 141 are provided at a position overlapping with the half second lever portion 127 in the X direction, that is, the feed direction of the tape 413. Thereby, the enlargement of the half first pressing portion 139 and the half second pressing portion 141 in the feed direction of the tape 413 can be suppressed.

Therefore, the distance from the full cutter 71 to the tape discharge portion 31 can be reduced, and the shortest length of the tape 413 that can be discharged by the tape discharge portion 31 can be reduced.

As illustrated in FIG. 33, when the full first pressing portion 131 presses the full first pressing target portion 215 toward the full-receiving portion 75, the full second pressing portion 133 is separated from the full second pressing target portion 217. Therefore, the full first pressing portion 131 can favorably press the full first pressing target portion 215 without being hindered by the engagement between the full second pressing portion 133 and the full second pressing target portion 217. As illustrated in FIG. 34, when the full second pressing portion 133 pulls the full second pressing target portion 217 toward the side opposite to the full-receiving portion 75, the full first pressing portion 131 is separated from the full first pressing target portion 215.

Similarly, as illustrated in FIG. 7, when the half first pressing portion 139 presses the half first pressing target portion 299 toward the half-receiving portion 79, the half second pressing portion 141 is separated from the half second pressing target portion 301. Therefore, the half first pressing portion 139 can favorably press the half first pressing target portion 299 without being hindered by the engagement between the half second pressing portion 141 and the half second pressing target portion 301. As illustrated in FIG. 19, when the half second pressing portion 141 pulls the half second pressing target portion 301 toward the side opposite to the half-receiving portion 79, the half first pressing portion 139 is separated from the half first pressing target portion 299.

Other Modification Examples

It needless to say that the present disclosure is not limited to the above-described embodiment, and various configurations can be employed without departing from the spirit of the present disclosure. A configuration in which the above-described embodiment and modification examples are combined may be employed.

Appendix

Hereinafter, a tape printing apparatus will be additionally described.

A tape printing apparatus includes a half cutter and a lid. The half cutter has a receiving portion and a movable portion, the movable portion includes a blade and comes into contact with or separates from the receiving portion, a first side, which is one side of the blade in a blade length direction, is open between the receiving portion and the movable portion, and the lid opens and closes a cutter mounting portion on which the half cutter is mounted. The lid is provided with a lid-side receiving support portion that supports at least one of an end on the first side of the receiving portion and an end on the first side of a support portion that supports the receiving portion pressed by the movable portion when the lid is closed.

According to the configuration, when the receiving portion is pressed by the movable portion, displacement of the receiving portion to a side opposite to the movable portion is suppressed, so that escape of a pressing force received by the receiving portion from the movable portion is suppressed, and the tape can be favorably half-cut.

In this case, the tape printing apparatus may further include a reaction force acting portion in which a reaction force from the receiving portion acts against a pressing force from the movable portion to the receiving portion. The lid may be provided with a reaction force support portion that supports an end on the first side of the reaction force acting portion when the lid is closed.

According to the configuration, the lid supports two places where pulling forces act on each other, that is, an end of the first side of the receiving portion and an end of the first side of the reaction force acting portion. Accordingly, when the receiving portion is pressed by the movable portion, the displacement of the receiving portion to the side opposite to the movable portion can be more effectively suppressed.

In this case, the cutter mounting portion may include a receiving mounting portion on which the receiving portion is detachably mounted, and a movable mounting portion on which the movable portion is detachably mounted.

According to the configuration, when a cutting condition of the half cutter deteriorates, the cutting condition of the half cutter can be recovered by replacing the receiving portion and the movable portion with new ones.

What is claimed is:

1. A tape printing apparatus comprising:

a half cutter having a receiving portion and a movable portion, the movable portion including a blade and coming into contact with or separating from the receiving portion, a first side, which is one side of the blade in a blade length direction, being open between the receiving portion and the movable portion; and a lid that opens and closes a cutter mounting portion on which the half cutter is mounted, wherein the lid is provided with a lid-side receiving support portion that supports at least one of an end on the first side of the receiving portion and an end on the first side of a support portion that supports the receiving portion pressed by the movable portion when the lid is closed.

2. The tape printing apparatus according to claim 1, further comprising:

a reaction force acting portion in which a reaction force from the receiving portion acts against a pressing force from the movable portion to the receiving portion, wherein the lid is provided with a reaction force support portion that supports an end on the first side of the reaction force acting portion when the lid is closed.

3. The tape printing apparatus according to claim 1, wherein the cutter mounting portion includes a receiving mounting portion on which the receiving portion is detachably mounted, and a movable mounting portion on which the movable portion is detachably mounted.

* * * * *